US007905715B2

(12) United States Patent
Hiwata et al.

(10) Patent No.: US 7,905,715 B2
(45) Date of Patent: Mar. 15, 2011

(54) SCROLL COMPRESSOR HAVING A FIXED SCROLL PART AND AN ORBITING SCROLL PART

(75) Inventors: Akira Hiwata, Kyoto (JP); Yoshiyuki Futagami, Shiga (JP); Teruyuki Akazawa, Shiga (JP); Noboru Iida, Shiga (JP); Kiyoshi Sawai, Shiga (JP); Hidenobu Shintaku, Shiga (JP); Takashi Morimoto, Kyoto (JP)

(73) Assignee: Panasonic Corporation, Kadoma-shi (JP)

( * ) Notice: Subject to any disclaimer, the term of this patent is extended or adjusted under 35 U.S.C. 154(b) by 220 days.

(21) Appl. No.: 10/560,620

(22) PCT Filed: Jun. 15, 2004

(86) PCT No.: PCT/JP2004/008700

§ 371 (c)(1),
(2), (4) Date: Mar. 5, 2007

(87) PCT Pub. No.: WO2005/001292

PCT Pub. Date: Jan. 6, 2005

(65) Prior Publication Data

US 2007/0178002 A1 Aug. 2, 2007

(30) Foreign Application Priority Data

Jun. 17, 2003 (JP) ..... 2003-171597
Jun. 24, 2003 (JP) ..... 2003-179187
Nov. 10, 2003 (JP) ..... 2003-379740

(51) Int. Cl.
*F03C 2/00* (2006.01)
*F03C 4/00* (2006.01)
*F04C 18/00* (2006.01)

(52) U.S. Cl. ..... 418/55.2; 418/55.5; 418/57; 418/142; 418/178; 418/179

(58) Field of Classification Search ..... 418/55.1–55.5, 418/57, 104, 142, 178, 179, 1
See application file for complete search history.

(56) References Cited

U.S. PATENT DOCUMENTS 5,584,678 A * 12/1996 Hirooka et al. ..... 418/55.2
(Continued)

FOREIGN PATENT DOCUMENTS

JP 58-67902 4/1983
(Continued)

OTHER PUBLICATIONS

Japanese Office Communication regarding corresponding Japanese Patent Application No. 2003-179187, dispatched on Jan. 13, 2009, and English translation.

(Continued)

*Primary Examiner* — Theresa Trieu
(74) *Attorney, Agent, or Firm* — Kratz, Quintos & Hanson, LLP

(57) ABSTRACT a First gap (15) in a thrust direction between teeth bottoms of a fixed mirror plate (2*b*) and teeth tips of an orbiting lap (4*a*), and a second gap (16) in the thrust direction between teeth bottoms of an orbiting mirror plate 4*b* and teeth tips of a fixed lap (2*a*) are formed such as to gradually increase from an outer peripheral side to an inner peripheral side of a scroll compressor, the first gap (15) is made greater than the second gap (16). Contact surface pressures of the laps (2*a*) and (4*a*) are kept low with respect to pressure formation, contact pressure of the teeth tips of the fixed scroll part (2) and the teeth bottoms of the orbiting scroll part (4)are equally maintained. With this loads applied to the scroll parts (2) and (4)are equally received by a thrust surface.

21 Claims, 11 Drawing Sheets

U.S. PATENT DOCUMENTS 6,299,424 B1 * 10/2001 Futagami et al. ..... 418/55.2

FOREIGN PATENT DOCUMENTS

| | | | | |
|---|---|---|---|---|
| JP | 2-16385 | | | 1/1990 |
| JP | 2-245487 | | | 10/1990 |
| JP | 4-5491 | | | 1/1992 |
| JP | 5-26186 | | | 2/1993 |
| JP | 05026186 | A | * | 2/1993 |
| JP | 05026187 | A | * | 2/1993 |
| JP | 6-317269 | | | 11/1994 |
| JP | 7-19187 | | | 1/1995 |
| JP | 7-285032 | | | 10/1995 |
| JP | 8-261170 | | | 10/1996 |
| JP | 8-284825 | | | 10/1996 |
| JP | 08261170 | A | * | 10/1996 |
| JP | 11-148470 | | | 6/1999 |
| JP | 11-241691 | | | 9/1999 |
| JP | 2000-97174 | | | 4/2000 |
| JP | 2000-352387 | | | 12/2000 |
| JP | 2001280252 | A | * | 10/2001 |
| JP | 2002-155875 | | | 5/2002 |
| JP | 2002-303279 | | | 10/2002 |
| JP | 2003328965 | A | * | 11/2003 |

OTHER PUBLICATIONS

Japanese Office Communication regarding corresponding Japanese Patent Application No. 2003-171597, dispatched on Jan. 13, 2009, and English translation.

International search report having mailing date Nov. 9, 2004, for international application No. PCT/JP2004/008700.

* cited by examiner

SCROLL COMPRESSOR HAVING A FIXED SCROLL PART AND AN ORBITING SCROLL PART

TECHNICAL FIELD

The present invention relates to a scroll compressor in which a fixed scroll part and an orbiting scroll part are meshed with each other to form a compression chamber, the orbiting scroll part is allowed to orbit, thereby moving a compression chamber while changing its capacity to carry out suction, compression and discharge.

BACKGROUND TECHNIQUE

As a refrigeration air conditioning hermetic compressor, there are conventional reciprocating type, rotary type and scroll type compressors, and these compressors are used in refrigeration or air conditioning fields of domestic or business purpose. Currently, compressors are developed while utilizing characteristics in terms of costs and performance.

Among them, a so-called hermetical compressor for preventing noise and eliminating the need of maintenance is a typical compressor in which a compressor mechanism and a motor are accommodated in a container, and a scroll compressor and a rotary compressor are in the mainstream. Generally, in the scroll compressor, a fixed scroll part in which a scroll lap rises from a mirror plate and an orbiting scroll part are meshed with each other to form a compression chamber therebetween, when the orbiting scroll part is allowed to orbit in a circular orbit while restraining the orbiting scroll part from rotating by a rotation-restraint mechanism, a compression chamber moves while changing its capacity, thereby carrying out the suction, compression and discharge, a predetermined back pressure is applied to an outer periphery of the orbiting scroll part and a back surface of a lap by lubricant oil, so that the orbiting scroll part is not separated from the fixed scroll part and does not flip over.

According to the conventional scroll, as shown in FIG. 17, a fixed scroll part 2 comprising a fixed lap 2*a* (lap 2*a*, hereinafter) and a fixed mirror plate 2*b* (mirror plate 2*b*, hereinafter) and an orbiting scroll part 4 comprising an orbiting lap 4*a* (lap 4*a*, hereinafter) and an orbiting mirror plate 4*b* (mirror plate 4*b*, hereinafter) are meshed with each other to form compression chambers 5 therebetween, and when the orbiting scroll part 4 is allowed to orbit in a circular orbit while restraining the orbiting scroll part 4 from rotating by a rotation-restraint mechanism 22, the compression chambers 5 move while changing capacity thereof, thereby carrying out suction, compression and discharge of refrigerant.

That is, the refrigerant is sucked into a suction pipe 1, passes through a suction space 3 of the fixed scroll part 2, and is enclosed in the compression chamber 5 formed between the fixed scroll part 2 and the orbiting scroll part 4, and compressed while reducing the capacity toward the center and is discharged from a discharge port 6.

At that time, the compression chambers 5 formed between the fixed scroll part 2 and the orbiting scroll part 4 are compressed and compression heat is generated. Thus, the scroll parts 2 and 4 are heated to high temperature by this heat. The pressures in the compression chambers 5 are gradually increased from the most outer peripheral compression chamber 5 toward the center compression chamber 5. Thus, temperature gradient is generated in the laps 2*a* and 4*a* from the most outer peripheral side toward the center. That is, the center (most inner peripheral side) compression chamber 5 is higher than the most outer peripheral compression chamber 5 in temperature. Due to this temperature rise, the laps 2*a* and 4*a* are thermally expanded, and especially inner peripheral ends of the laps 2*a* and 4*a* located on the center side which is heated to high temperature are largely thermally expanded. For this reason, when the laps 2*a* and 4*a* are thermally expanded, a gap in the thrust direction between teeth tips of the laps 2*a* and 4*a* and teeth bottoms of the mirror plates 2*b* and 4*b* becomes smaller than a gap at the time of assembling operation, and teeth tips of the laps 2*a* and 4*a* come into contact with the teeth bottoms of the mirror plates 2*b* and 4*b*. If the contact surface pressure is increased, there is a fear that galling is generated therebetween, and the mirror plates 2*b* and 4*b* and the laps 2*a* and 4*a* are damaged.

Hence, according to a scroll compressor described in patent document 1, a height of a lap of the orbiting scroll part or the fixed scroll part is adjusted between the teeth bottom to the teeth tip of the mirror plate, and a thrust direction gap is formed between the teeth tips of each lap to teeth bottoms of the other lap such that the gap becomes the greatest on the most inner peripheral side in the assembled state.

According to a scroll compressor described in patent document 2, a temperature distribution of surfaces of the teeth tips of the lap is measured, based on a result of the measurement, teeth tips of at least one of the lap of the orbiting scroll part or the fixed scroll part are formed such that the thrust direction gap between the teeth bottoms of the other lap becomes the greatest on the most inner peripheral side or the thrust direction gap is formed such that the gap is varied in a plurality of stages.

According to a scroll compressor described in patent document 3, as shown in FIG. 17, refrigerant gas sucked into the suction pipe 1 passes through the suction space 3 of the fixed scroll part 2 comprising the lap 2*a* and the mirror plate 2*b*, and is enclosed in the compression chamber 5 formed by meshing the fixed scroll part 2 with the orbiting scroll part 4 comprising the lap 4*a* and the mirror plate 4*b*, the refrigerant gas is compressed while reducing the capacity thereof toward the center of the fixed scroll part 2, and is discharged from the discharge port 6.

A back pressure chamber 8 is formed such as to be surrounded by the orbiting scroll part 4 and a sliding partition ring 17 mounted in a ring-like groove of a bearing member 7. The pressure in the back pressure chamber 8 is set to an intermediate pressure between discharge pressure and suction pressure, and the intermediate pressure is controlled such that this pressure becomes constant by a back pressure adjusting mechanism 9. The sliding partition ring 17 slides with a back surface 4*d* of the orbiting scroll part 4.

The back pressure adjusting mechanism 9 has a communication passage 10 which is in communication with a suction space 3 through the fixed scroll part 2 from the back pressure chamber 8, and the communication passage 10 is provided with a valve 11. If the pressure in the back pressure chamber 8 becomes higher than a set pressure, the valve 11 is opened, oil in the back pressure chamber 8 is supplied to the suction space 3, and the pressure in the back pressure chamber 8 is maintained at a constant intermediate pressure. The oil supplied to the suction space 3 moves to the compression chambers 5 together with the orbiting motion, and this prevents oil from leaking between the compression chambers 5. The intermediate pressure is applied to a back surface of the orbiting scroll part 4 to prevent the scroll compressor from flipping over. If the scroll compressor flips over, the fixed scroll part 2 and the orbiting scroll part 4 are separated, and oil leaks from that portion.

Iron-based material mainly comprising cast iron is used for the fixed scroll part 2 and the orbiting scroll part 4 which constitute the scroll compressor, or iron-based material is used for the fixed scroll part 2 and aluminum-based material is used for the orbiting scroll part 4.

(Patent Document 1)

Japanese Patent Application Laid-open No. S58-67902

(Patent Document 2)

Japanese Patent Application Laid-open No. H7-019891

(Patent Document 3)

Japanese Patent Application Laid-open No. 2001-280252

However, in the above structures, deformations of the fixed scroll part and orbiting scroll part caused by pressure are not taken into consideration, and when the scroll compressor is operated under high load or carbon dioxide is used as a refrigerant, the contact pressure acting on the teeth tips of the fixed scroll part and teeth bottoms of the orbiting scroll part becomes uneven, and there is a fear that galling or abnormal wearing is generated and there is a problem that the durability is deteriorated.

Hence, the present invention has been accomplished in view of the conventional problem, and it is an object of the invention to provide an efficient and reliable scroll compressor although the scroll compressor is simple and inexpensive.

When carbon dioxide is used as a refrigerant, the discharge pressure of the compressor on the high pressure side is higher than that of the conventional compressor by about 7 to 10 times. Thus, if a back pressure enough to prevent the orbiting scroll part from separating from the fixed scroll part is applied, the orbiting scroll part is strongly pushed against the fixed scroll part, abnormal wearing or seizing is generated, and performance is deteriorated by input increase.

In a system having large capacity and uses much refrigerant, at the time of transient operation wherein liquid refrigerant returns abruptly, shortage of lubricant oil or temperature rise is generated on a thrust surface of the orbiting scroll part due to carbon dioxide liquid refrigerant having high cleaning ability, and there is a fear that seizing is generated from the aluminum surface.

When both the scroll parts are made of metal, i.e., iron-based materials having the same coefficient of thermal expansion, since the gravity of the orbiting scroll part becomes great, centrifugal force at the time of operation is increased and as a result, a load of the bearing member is increased, and sliding loss is also increased. Especially when the scroll compressor is operated at high speed, since the centrifugal force is extremely increased, a main shaft and the bearing member are abruptly worn. In order to enhance the precision of the lap, it is necessary to precisely machine the mounting surface and the sliding surface, but since the cutting performance of the iron-based material is low, it is extremely difficult to machine the iron-based material, and it is difficult to enhance the productivity.

If each of the compression chambers is compressed, compression heat is generated, and each scroll part is heated to high temperature due to this heat. The pressure in the compression chambers is gradually increased from the most outer peripheral compression chamber toward the center compression chamber, and temperature gradient is generated from the most outer peripheral side toward the center in the lap. That is, the temperature of the center side (most inner peripheral side) compression chamber becomes higher than that of the most outer peripheral compression chamber. The lap is thermally expanded due to this temperature rise, and especially the inner peripheral side of the lap located on the central side where the temperature is increased is largely thermally expanded. For this reason, when the lap is thermally expanded, a gap in the thrust direction between teeth tips of the lap and teeth bottoms of the mirror plates becomes smaller than a gap at the time of assembling operation, and teeth tips of the lap come into contact with the teeth bottoms of the mirror plates. If the contact surface pressure is further increased, there is a fear that galling is generated therebetween, the mirror plates and the lap are damaged, and there is a problem that the compression efficiency and durability of the compressor are deteriorated. Especially when iron-based material is used for the fixed scroll part, aluminum-based material is used for the orbiting scroll part and metals having different coefficient of thermal expansion are used, this problem appears seriously.

If one or both of the orbiting scroll part and fixed scroll part are provided with chip seals to avoid the performance deterioration caused by the thrust direction gap, there is a problem that the chip seals are contacted, the sliding loss is increased, the number of parts is increased, the number of machining steps is increased and the productivity is deteriorated.

Hence, it is another object of the present invention to provide an efficient and reliable scroll compressor when carbon dioxide is used as a refrigerant.

In the scroll compressor described in patent document 2, each compression chamber formed between the fixed scroll part and the orbiting scroll part is thermally expanded due to compression heat caused by compression, and this fact is taken into consideration. However, deformations of the fixed scroll part and orbiting scroll part caused by pressure difference between the discharge pressure and the suction pressure of the compressor are not taken into consideration. Especially in the housing of an eccentric bearing in the orbiting scroll part, the thickness of the mirror plate of the orbiting scroll part is thin, the deformation toward the fixed scroll part is large due to the pressure difference between the discharge pressure and the suction pressure, the teeth bottoms of the orbiting scroll and the teeth tips of the fixed scroll eccentrically abut against each other, the contact surface pressure is increased, galling is generated therebetween, and there is a problem that the compression efficiency and durability of the compressor are deteriorated.

Hence, it is another object of the present invention to provide a reliable scroll compressor realizing high efficiency from the initial stage of operation while taking the pressure deformation in the housing of the eccentric bearing in the orbiting scroll is taken into consideration.

DISCLOSURE OF THE INVENTION

A first aspect of the present invention provides a scroll compressor in which a scroll fixed lap rising from a fixed mirror plate of a fixed scroll part and a scroll orbiting lap rising from an orbiting mirror plate of an orbiting scroll part are meshed with each other to form compression chambers therebetween, the orbiting scroll part is allowed to orbit in a circular orbit while restraining the orbiting scroll part from rotating by a rotation-restraint mechanism, a refrigerant is sucked, compressed and discharged while continuously varying a capacity of the compression chamber, wherein a first gap in a thrust direction between teeth bottoms of the fixed mirror plate and teeth tips of the orbiting lap and a second gap in a thrust direction between teeth bottoms of the orbiting mirror plate and teeth tips of the fixed lap are formed into such shapes that the first and second gaps are gradually increased from an outer peripheral side to an inner peripheral side of the scroll compressor, and the first gap is made greater than the second gap.

With this aspect, since the first gap and the second gap are gradually increased from the outer peripheral side to the inner peripheral side, the contact surface pressure of the lap caused by the thermally expansion can be maintained at low level, and even if the fixed scroll part is downwardly concaved by the discharge pressure, since the first gap greater than the suction pressure absorbs the pressure deformed portion, the contact pressure between the teeth tips of the fixed scroll part and the teeth bottoms of the orbiting scroll part is maintained equally. Therefore, galling or abnormal wearing is not generated, and it is possible to provide a reliable scroll compressor.

According to a second aspect of the invention, in the scroll compressor of the first aspect, the first gap is formed such that height of the orbiting lap is varied, and second gap is formed such that thickness of the orbiting mirror plate is varied.

With this aspect, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

According to a third aspect of the invention, in the scroll compressor of the first aspect, the first gap is formed such that height of the orbiting lap is varied, the second gap is formed such that the height of the fixed lap is varied.

With this aspect, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

According to a fourth aspect of the invention, in the scroll compressor of the first aspect, the first gap is formed such that thickness of the fixed mirror plate is changed, second gap is formed such that the thickness of the orbiting mirror plate is changed.

With this aspect, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

According to a fifth aspect of the invention, in the scroll compressor of the first aspect, the first gap is formed such that the thickness of the fixed mirror plate is changed, second gap is formed such that the height of the fixed lap is varied.

With this aspect, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

According to a sixth aspect of the invention, in the scroll compressor of the fifth aspect, carbon dioxide is used as the refrigerant, the thickness of the orbiting mirror plate is smaller than 3.0 times of the height of the orbiting lap.

With this aspect, the orbiting scroll part having appropriate relation between the thickness of the mirror plate and the height of the lap is flexibly deformed with respect to the pressure difference between the discharge pressure and the suction pressure when carbon dioxide refrigerant is used, the contact pressure of the teeth tips of the fixed scroll part and the teeth bottoms of the orbiting scroll part is maintained more equally, galling or abnormal wearing is not generated, and it is possible to provide a reliable scroll compressor.

According to a seventh aspect of the invention, in the scroll compressor of the fifth aspect, HFC-based refrigerant or HCFC-based refrigerant is used as the refrigerant, and the thickness of the orbiting mirror plate is smaller than 1.0 times of the height of the orbiting lap.

With this aspect, the orbiting scroll part having appropriate relation between the thickness of the mirror plate and the height of the lap is flexibly deformed with respect to the pressure difference between the discharge pressure and the suction pressure when HFC-based refrigerant or HCFC-based refrigerant is used, the contact pressure of the teeth tips of the fixed scroll part and the teeth bottoms of the orbiting scroll part is maintained more equally, galling or abnormal wearing is not generated, and it is possible to provide a reliable scroll compressor.

According to an eighth aspect of the invention, in the scroll compressor of any one of first to fifth aspects, HC-based refrigerant is used as the refrigerant, and the thickness of the orbiting mirror plate is smaller than 0.6 times of the height of the orbiting lap.

With this aspect, the orbiting scroll part having appropriate relation between the thickness of the mirror plate and the height of the lap is flexibly deformed with respect to the pressure difference between the discharge pressure and the suction pressure when HC-based refrigerant is used, the contact pressure of the teeth tips of the fixed scroll part and the teeth bottoms of the orbiting scroll part is maintained more equally, galling or abnormal wearing is not generated, and it is possible to provide a reliable scroll compressor.

A ninth aspect of the invention provides a scroll compressor in which scroll fixed lap rising from a fixed mirror plate of a fixed scroll part and scroll orbiting lap rising from an orbiting mirror plate of an orbiting scroll part are meshed with each other to form compression chambers therebetween, the orbiting scroll part is allowed to orbit in a circular orbit while restraining the orbiting scroll part from rotating by a rotation-restraint mechanism, a refrigerant is sucked, compressed and discharged while continuously varying a capacity of the compression chamber, wherein carbon dioxide is used as a refrigerant, the fixed scroll part is made of iron-based material, the orbiting scroll part is made of aluminum-based material, the orbiting scroll part is subjected to surface processing, teeth tips of the orbiting lap are inclined such that a first gap in thrust direction between teeth bottoms of the fixed mirror plate and teeth tips of the orbiting lap is increased from an outer peripheral side to an inner peripheral side of the scroll compressor.

With this aspect, the fixed scroll part is made of iron-based material, the orbiting scroll part is made of aluminum-based material, and the orbiting scroll part is subjected to surface processing. Therefore, when the scroll compressor is operated with large pressure difference while using carbon dioxide as the refrigerant, even if the teeth bottoms of the orbiting mirror plate are strongly pushed against the teeth tips of the fixed lap, abnormal wearing is suppressed by the surface processing having the hardened layer, and the scroll compressor can be operated without generating seizing. According to this aspect, also at the time of transient operation of the scroll compressor having abrupt liquid refrigerant return in a large capacity system using a large amount of refrigerant, lubricant oil on the thrust surface of the orbiting scroll part is not washed away by carbon dioxide liquid refrigerant having high cleaning ability, and seizing by temperature rise is not generated. According to this aspect, since the orbiting scroll part is made of aluminum-based material, the centrifugal force of the driving portion at the time of high speed operation can be reduced, durability is excellent, and sliding loss can be reduced. According to this aspect, the teeth tips of the orbiting lap are inclined such that the first gap in the thrust direction between teeth bottoms of the fixed mirror plate and the teeth tips of the orbiting lap is increased from an outer peripheral side to an inner peripheral side of the scroll compressor. With this, it is possible to prevent the teeth tips at the center of the lap in the orbiting scroll part from coming into contact with the high compression heat generated at the center portion in the course of compression.

According to a tenth aspect of the invention, in the scroll compressor of the ninth aspect, the smallest height of the orbiting lap on inner peripheral side is 99.6% or more and less than 100% of the largest height of the orbiting lap on outer peripheral side.

With this aspect, leakage loss from the teeth tip surface of each lap is reduced, it is possible to prevent galling in the teeth tip surface of each lap, and leakage from the teeth tip can be suppressed to the minimum value, and it is possible to enhance both performance and reliability of the compressor.

An eleventh aspect of the invention provides a scroll compressor in which a scroll fixed lap rising from a fixed mirror plate of a fixed scroll part and a scroll orbiting lap rising from an orbiting mirror plate of an orbiting scroll part are meshed with each other to form compression chambers therebetween, the orbiting scroll part is allowed to orbit in a circular orbit while restraining the orbiting scroll part from rotating by a rotation-restraint mechanism, a refrigerant is sucked, compressed and discharged while continuously varying a capacity of the compression chamber, wherein carbon dioxide is used as a refrigerant, the fixed scroll part is made of iron-based material, the orbiting scroll part is made of aluminum-based material, the orbiting lap is subjected to surface processing except teeth tips thereof.

With this aspect, it is possible to prevent the teeth tips of the center portion of the lap in the orbiting scroll part from coming into contact with high compression heat generated at the center portion in the course of compression. Even if the center teeth tip of the lap comes into contact with the high compression heat, since the teeth tip is not subjected to the surface processing, the thrust direction gap between the teeth tips of the fixed scroll part and the teeth bottoms of the fixed mirror plate is adjusted without generating seizing during operation. Therefore, it is possible to enhance both performance and reliability of the compressor and thus, cost can be reduced.

According to a twelfth aspect of the invention, in the scroll compressor of any one of ninth to eleventh aspects, teeth bottoms of the orbiting mirror plate are inclined such that a second gap in thrust direction between the teeth bottoms of the orbiting mirror plate and teeth tips of the fixed lap is increased from outer peripheral side to inner peripheral side of the scroll compressor.

With this aspect, when the scroll compressor is operated with large pressure difference while using carbon dioxide as the refrigerant, it is possible to prevent the teeth tips of the scroll lap of the fixed scroll part from coming into contact with the teeth bottoms of the teeth bottoms of the orbiting mirror plate, and the reliability is enhanced.

According to a thirteenth aspect of the invention, in the scroll compressor of any one of ninth to eleventh aspects, any of alumite coating processing, PVD processing and nickel phosphorus plating processing is carried out as the surface processing.

With this aspect, even if the pressure difference of he carbon dioxide refrigerant is high, wear of film having the hardened layer by slide by slide is small, the surface processing film remains even if the scroll compressor is used for a long time, seizing is not generated, and the reliability is enhanced.

According to a fourteenth aspect of the invention, in the scroll compressor of any one of ninth to eleventh aspects, a portion subjected to the surface processing is subjected to any of lapping processing, buff processing and barrel polishing processing.

With this aspect, by reducing the roughness caused by the surface processing, performance is enhanced by reducing the sliding loss, and high efficiency can be obtained from the initial stage of operation.

A fifteenth aspect of the invention provides a scroll compressor in which a scroll fixed lap rising from a fixed mirror plate of a fixed scroll part and a scroll orbiting lap rising from an orbiting mirror plate of an orbiting scroll part are meshed with each other to form compression chambers therebetween, when said orbiting scroll part is allowed to orbit in a circular orbit while restraining said orbiting scroll part from rotating by a rotation-restraint mechanism, a compression chamber moves while changing its capacity, thereby carrying out suction, compression and discharge, wherein teeth bottoms of said orbiting scroll are inclined such that a second gap in thrust direction between teeth bottoms of said orbiting scroll part and teeth tips of said fixed scroll part is increased from outer peripheral side to inner peripheral side of said scroll compressor, and said teeth bottoms of said orbiting scroll and said teeth tips of said fixed scroll are formed such that said second gap is constant and largest in a range corresponding to a housing of an eccentric bearing of at least said orbiting scroll part.

With this aspect, in the housing of the eccentric bearing having thin mirror plate of the orbiting scroll, even when the pressure deformation is generated by the pressure difference between the discharge pressure and the suction pressure, the teeth bottoms of the orbiting scroll and the teeth tips of the fixed scroll do not eccentrically abut against each other but equally come into contact with each other, the reliability is enhanced and high efficiency can be obtained from the initial stage of operation.

According to a sixteenth aspect of the invention, in the scroll compressor of the fifteenth aspect, the teeth bottoms of the orbiting scroll are formed with an inclined surface which is recessed from its outer peripheral side to inner peripheral side thereof with respect to the fixed scroll such that the second gap is increased from the outer peripheral side to the inner peripheral side, the teeth bottoms of the orbiting scroll corresponding to the housing of the eccentric bearing of at least the orbiting scroll part is provided with a flat portion which is a largest recess.

With this aspect, in the housing of the eccentric bearing having thin mirror plate of the orbiting scroll, even when the pressure deformation is generated by the pressure difference between the discharge pressure and the suction pressure, since the teeth bottoms of the orbiting scroll have shape in which the pressure deformation is taken into account, the teeth bottoms of the orbiting scroll and the teeth tips of the fixed scroll do not eccentrically abut against each other but equally come into contact with each other, the reliability is enhanced and high efficiency can be obtained from the initial stage of operation.

According to a seventeenth aspect of the invention, in the scroll compressor of the fifteenth aspect, the teeth tips of the fixed scroll part are provided with an inclined surface such that lap height is reduced from the outer peripheral side to the inner peripheral side, and the mirror plate of the orbiting scroll is provided with a flat portion which lap height of the fixed scroll opposed to the teeth bottoms of the orbiting scroll corresponding to the housing of the eccentric bearing of at least the orbiting scroll part becomes a smallest height.

With this aspect, in the housing of the eccentric bearing having thin mirror plate of the orbiting scroll, even when the pressure deformation is generated by the pressure difference between the discharge pressure and the suction pressure, since the teeth tips of the fixed scroll have shape in which the pressure deformation is taken into account, the teeth bottoms of the orbiting scroll and the teeth tips of the fixed scroll do not eccentrically abut against each other but equally come into contact with each other, the reliability is enhanced and high efficiency can be obtained from the initial stage of operation.

According to an eighteenth aspect of the invention, in the scroll compressor of any one of the fifteenth to seventeenth aspects, the teeth tips of the orbiting scroll part are inclined such that a first gap in thrust direction of the teeth tips of the orbiting scroll part and teeth bottoms of the fixed scroll part is increased from the outer peripheral side to the inner peripheral side.

With this aspect, compression heat is generated in the center portion in the course of compression and the center portion is heated to high temperature and thus, the height of the center teeth tip is increased by the thermally expansion and this prevent the teeth tip from coming into contact.

According to a nineteenth aspect of the invention, in the scroll compressor of any one of the fifteenth to seventeenth aspects, the teeth bottoms of the fixed scroll part are inclined such that a first gap in thrust direction of the teeth tips of the orbiting scroll part and teeth bottoms of the fixed scroll part is increased from the outer peripheral side to the inner peripheral side.

With this aspect, compression heat is generated in the center portion in the course of compression and the center portion is heated to high temperature and thus, the height of the center teeth tip is increased by the thermally expansion and this prevent the teeth tip from coming into contact.

According to a twentieth aspect of the invention, in the scroll compressor of any one of the fifteenth to eighteenth aspects, the orbiting scroll part is subjected to any of alumite coating processing, PVD processing and nickel phosphorus plating processing as a surface processing.

With this aspect, abnormal wearing is suppressed by the surface processing having the hardened layer, and the scroll compressor can be operated without generating seizing. Also at the time of transient operation of the scroll compressor having abrupt liquid refrigerant return in a large capacity system using a large amount of refrigerant, lubricant oil on the thrust surface of the orbiting scroll part is not washed away by carbon dioxide liquid refrigerant having high cleaning ability, seizing is not generated even if temperature rises, and the reliability can be secured.

According to a twenty-first aspect of the invention, in the scroll compressor of any one of the fifteenth to nineteenth aspects, high pressure refrigerant, e.g., carbon dioxide is used as a refrigerant.

With this aspect, even if the refrigerant is carbon dioxide and the teeth bottoms of the orbiting scroll are deformed by pressure, it is possible to effectively prevent the galling or abnormal wearing.

BEST MODE FOR CARRYING OUT THE INVENTION

Embodiments of the present invention will be explained with reference to the drawings.

First Embodiment

Figure 1:
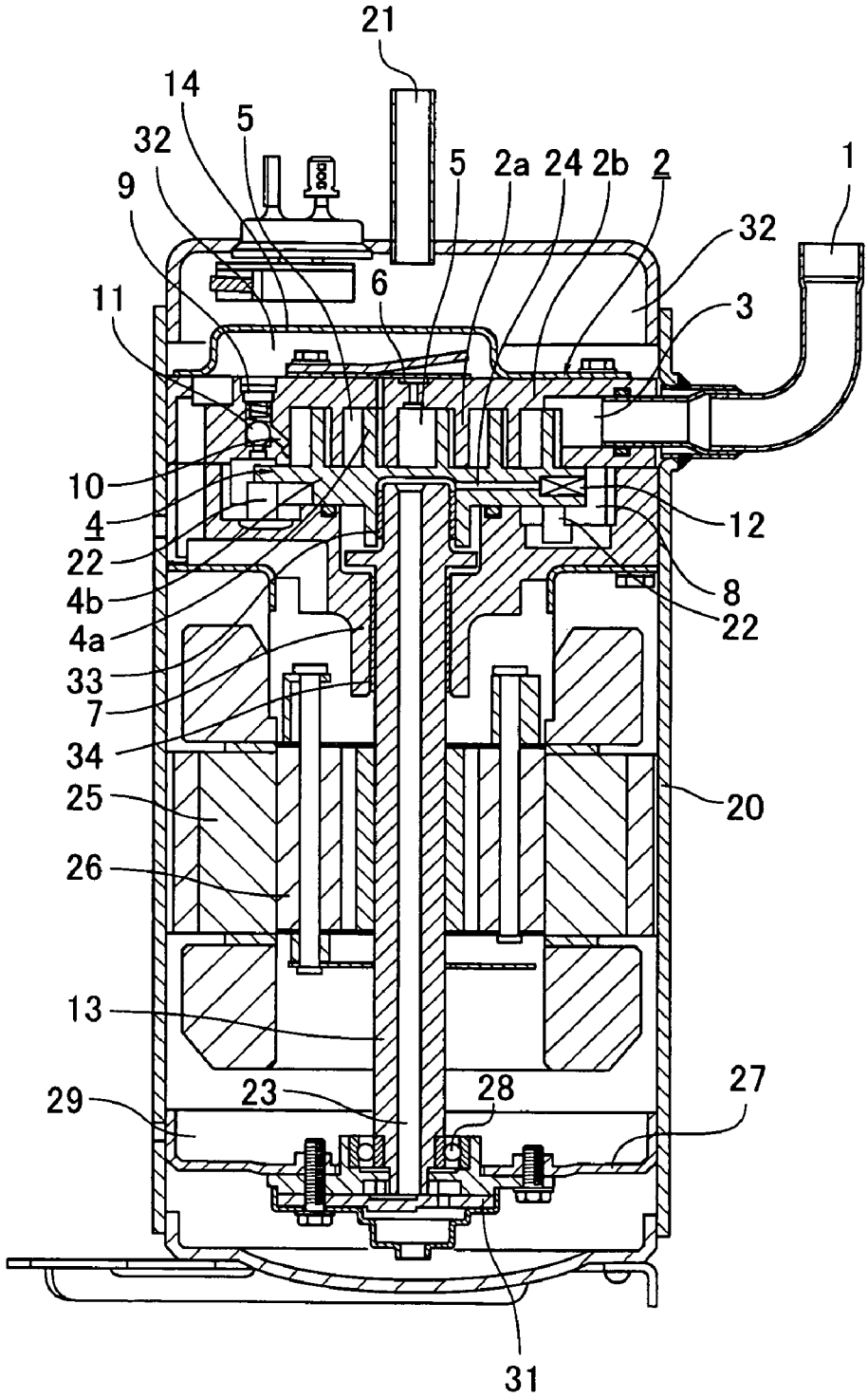
FIG. 1 is a vertical sectional view showing a scroll compressor according to a first embodiment of the present invention.
Figure 7:
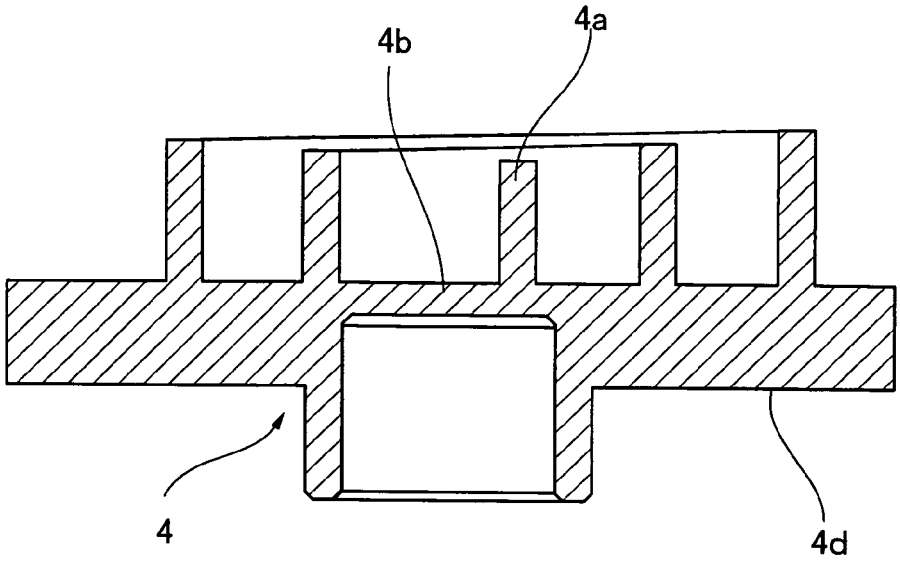
FIG. 7 is a sectional view of a side surface of the orbiting scroll part of the scroll compressor shown in FIG. 4.

FIG. 1 is a sectional view showing a scroll compressor of a first embodiment of the present invention. In the scroll compressor of the first embodiment shown in FIG. 1, the same members as those of the conventional scroll compressor shown in FIG. 7 are designated with the same symbols.

The scroll compressor of the embodiment includes a compressor mechanism and a motor mechanism in a container 20. The compressor mechanism is disposed at an upper portion in the container 20, and the motor mechanism is disposed below the compressor mechanism. The container 20 is provided at its upper portion with a suction pipe 1 and a discharge pipe 21. An oil reservoir 29 for accumulating lubricant oil is provided at a lower portion in the container 20.

The compressor mechanism includes a fixed scroll part 2 and an orbiting scroll part 4. The fixed scroll part 2 and the orbiting scroll part 4 are meshed with each other to form a plurality of compression chambers 5. The fixed scroll part 2 has a fixed lap 2*a* (lap 2*a*, hereinafter) rising from a fixed mirror plate 2*b* (mirror plate 2*b*, hereinafter), and the orbiting scroll part 4 has an orbiting lap 4*a* (lap 4*a*, hereinafter) rising from an orbiting mirror plate 4*b* (mirror plate 4*b*, hereinafter). The compression chambers 5 are formed between the mirror plate 2*b* and the mirror plate 4*b* by meshing the lap 2*a* and the lap 4*a* with each other.

The orbiting scroll part 4 is restrained from rotating by a rotation-restraint mechanism 22, and the orbiting scroll part 4 orbits in a circular orbit. The compression chamber 5 moves while varying its capacity by orbiting motion of the orbiting scroll part 4. Predetermined back pressure is applied to an outer periphery of the orbiting scroll part 4 and a back surface of the lap so that the orbiting scroll part 4 is not separated from the fixed scroll part 2 and does not flip over.

The motor mechanism includes a stator 25 which is fixed to an inner side of the container 20, and a rotor 26 which is rotatably supported on the inner side of the stator 25. A shaft 13 is fitted into the rotor 26. The shaft 13 is supported by a bearing member 7 and a ball bearing 28 held by an auxiliary bearing member 27.

Refrigerant sucked from the suction pipe 1 passes through the suction space 3 of the fixed scroll part 2, and is enclosed in the compression chamber 5 formed by meshing the fixed scroll part 2 and the orbiting scroll part 4 with each other, and is compressed toward the center of the fixed scroll part 2 while reducing the capacity, and is discharged into an upper space 32 in the container 20 from a discharge port 6. An interior of a muffler 14 covering the discharge port 6 is a portion of the upper space 32.

The back pressure chamber 8 is formed such as to be surrounded by the fixed scroll part 2 and the bearing member 7. It is necessary that the back pressure chamber 8 always has such a back pressure that the orbiting scroll part 4 is not separated from the fixed scroll part 2. The back pressure adjusting mechanism 9 always maintains the back pressure of the orbiting scroll part 4 at constant level. The back pressure adjusting mechanism 9 includes a communication passage 10 which is in communication with the suction space 3 from the back pressure chamber 8 through the fixed scroll part 2, and the communication passage 10 is provided with a valve 11.

If the pressure in the back pressure chamber 8 becomes higher than a set pressure, the valve 11 is opened, lubricant oil in the back pressure chamber 8 is supplied to the suction space 3, and the pressure in the back pressure chamber 8 is maintained at a constant intermediate pressure. The intermediate pressure is applied to the back surface of the orbiting scroll part 4 so as to prevent the orbiting scroll part 4 from flipping over during operation. The lubricant oil supplied to the suction space 3 moves to the compression chamber 5 together with the orbiting motion of the orbiting scroll part 4, and this prevents refrigerant from leaking from the compression chamber 5.

Lubricant oil accumulated in the oil reservoir 29 is introduced into an upper end of the shaft 13 by an oil pump 31 through the passage 23 formed in the shaft 13. The lubricant oil introduced into the upper end of the shaft 13 lubricates the sliding surface 33 between the shaft 13 and the orbiting scroll part 4 and the sliding surface 34 between the shaft 13 and the bearing member 7. A portion of the lubricant oil passes through the passage 24 provided in the orbiting scroll part 4, and is decompressed by the narrowed portion 12 mounted on the passage 24 and then, is supplied to the back pressure chamber 8. If the pressure in the back pressure chamber 8 becomes higher than the set pressure and the valve 11 is opened, lubricant oil accumulated in the back pressure chamber 8 is supplied to the suction space 3 and the compression chamber 5, and the lubricant oil is used for lubricating the meshing sliding surface and functions as seal oil.

The structure of the scroll compressor and its operation of the embodiment will be explained with reference to an enlarged sectional view of the compression mechanism shown in FIG. 2 and a schematic sectional view shown in FIG. 3.

Figure 2:
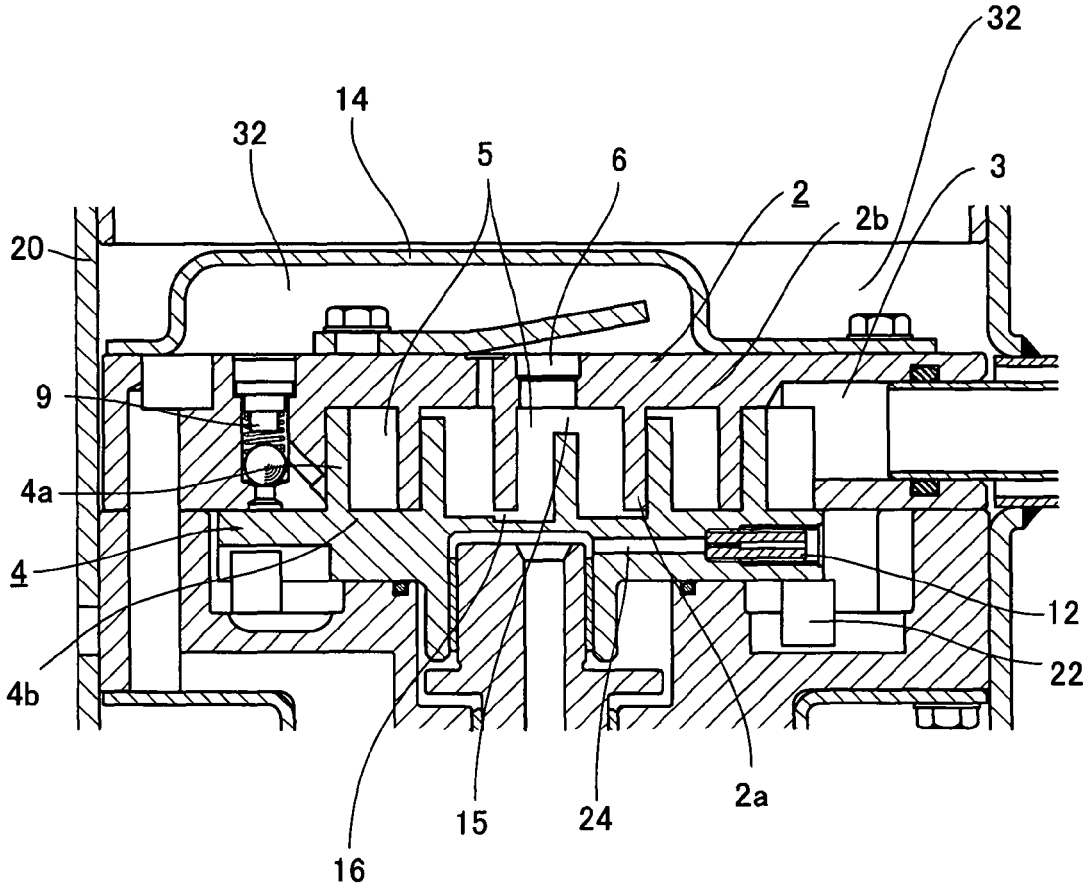
FIG. 2 is an enlarged sectional view of a compression mechanism of the scroll compressor shown in FIG. 1.

In the compression mechanism shown in FIG. 2, a height of the lap 4*a* of the orbiting scroll part 4 is changed so that a first gap 15 in the thrust direction between the teeth bottoms of the mirror plate 2*a* of the fixed scroll part 2 and the teeth tips of the lap 4*a* of the orbiting scroll part 4 is gradually increased from the outer peripheral side toward the inner peripheral side. A thickness of the mirror plate 4*b* of the orbiting scroll part 4 is changed so that a second gap 16 in the thrust direction between the teeth bottoms of the mirror plate 4*b* of the orbiting scroll part 4 and the teeth tips of the lap 2*a* of the fixed scroll part 2 is gradually increased from the outer peripheral side toward the inner peripheral side.

Figure 3:
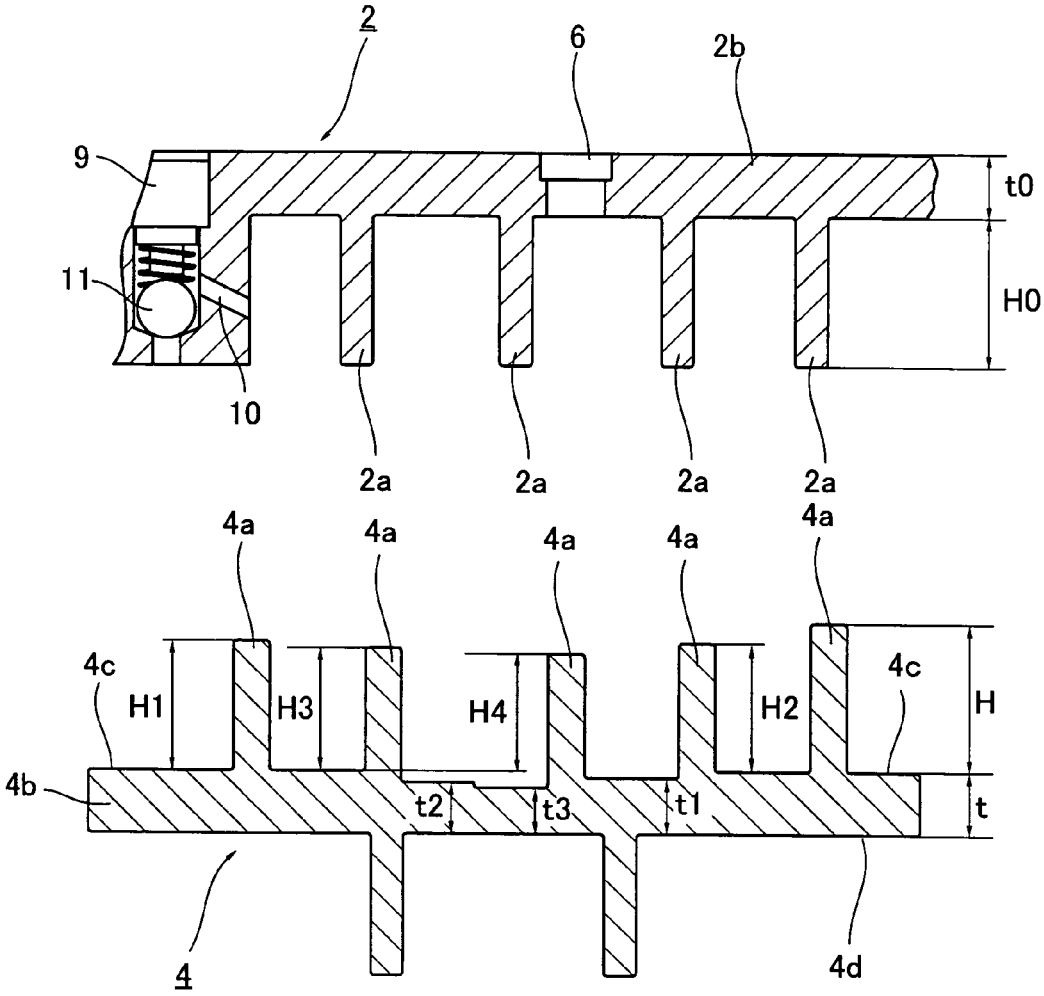
FIG. 3 is a schematic scroll compressor of the compression mechanism of the scroll compressor shown in FIG. 1.

For example, in the schematic sectional view of the compression mechanism shown in FIG. 3, the height (height H of the lap 4*a* from the teeth bottom surface 4*c* shown in FIG. 3) of the lap 4*a* of the orbiting scroll part 4 is reduced in stages from the outer peripheral side toward the inner peripheral side in the order of H1, H2, H3 and H4, thereby forming the first gap 15. The thicknesses (thicknesses t of the mirror plate 4*b* from the back surface 4*d* shown in FIG. 3) of the mirror plate 4*b* of the orbiting scroll part 4 are reduced in stages from the outer peripheral side toward the inner peripheral side by recessing the teeth bottom surface 4*c* in the order of t1, t2 and t3, thereby forming the second gap 16.

The first gap 15 is greater than the second gap 16. In the fixed scroll part 2 shown in FIG. 3, the height H0 of the lap 2*a* and the thickness t0 of the mirror plate 2*b* are constant.

When the scroll compressor having the above-described structure is operated, the pressure in the compression chamber 5 rises from the suction pressure to the discharge pressure, a refrigerant gas of the discharge pressure exists in the upper space 32 located opposite side from the compression chamber 5 with respect to the mirror plate 2*a* of the fixed scroll part 2. Therefore, since the outer periphery of the fixed scroll part 2 is held by the thrust surface, the fixed scroll part 2 is distorted in a convex manner toward the compressed space due to the pressure difference between the compressed space and the upper space 32. Further, compression heat is generated in the compression chamber 5 formed between the fixed scroll part 2 and the orbiting scroll part 4 due to the compression effect and thus, the laps 2*a* and 4*a* are heated to high temperature by this heat. Since the pressure in the compression chambers 5 is gradually increased from the compression chamber 5 on the most outer peripheral side toward the center compression chamber 5, a temperature gradient is generated in the laps 2*a* and 4*a* toward the center. That is, the center side (most inner peripheral side) compression chamber 5 is higher than the most outer peripheral side compression chamber 5 in temperature. The laps 2*a* and 4*a* are thermally expanded due to this temperature rise, and especially the center side laps 2*a* and 4*a* are largely thermally expanded.

According to the scroll compressor of the embodiment, since the first gap 15 is greater than the second gap 16, even if the fixed scroll part 2 receives the above-described pressure deformation, the teeth bottoms of the mirror plate 4*b*, the teeth tips of the lap 2*a* and the outer peripheral thrust surface come into contact before the teeth bottoms of the mirror plate 2*b* and the teeth tips of the lap 4*a* come into contact.

That is, with respect to the excessive thrust generated when the scroll compressor is operated under high load, since the first gap 15 which is greater than the second gap 16 absorbs the deformation caused by this thrust, it is possible to equally maintain the contact pressure of the teeth tips of the lap 2*a* of the fixed scroll part 2 and the teeth bottoms of the mirror plate 4*b* of the orbiting scroll part 4. Therefore, galling or abnormal wearing is not generated. Further, since the first gap 15 is greater than the second gap 16, even if the laps 2*a* and 4*a* affected by the thermally expansion, it is possible to maintain the contact surface pressure of the teeth tips of the laps 2*a* and 4*a* at low level. Therefore, galling or abnormal wearing is not generated, and it is possible to provide a reliable scroll compressor.

In the first embodiment, the first gap 15 is formed such that the height of the lap 4*a* is varied, and the second gap 16 is formed such that the thickness of the mirror plate 4*b* is varied, and the reducing degree of the height of the lap 4*a* is greater than the reducing rate of the thickness of the mirror plate 4*b*. Alternatively, the following structures may be employed.

For example, the height of the lap 4*a* of the orbiting scroll part 4 may be changed such that the first gap 15 is gradually increased from its outer peripheral side toward inner peripheral side, the height of the lap 2*a* of the fixed scroll part 2 is varied, the second gap 16 is gradually increased from its outer peripheral side toward inner peripheral side. In the case of this structure, the thickness of the mirror plate 2*b* and the thickness of the mirror plate 4*b* are set constant.

The thickness of the mirror plate 2*b* of the fixed scroll part 2 may be varied such that the first gap 15 is gradually increased from its outer peripheral side to inner peripheral side, and the thickness of the mirror plate 2*b* of the fixed scroll part 2 may be varied such that the second gap 16 is gradually increased from its outer peripheral side to inner peripheral side. In the case of this structure, the height of the lap 2*a* and height of the lap 4*a* are set constant.

Further, the thickness of the mirror plate 2*b* of the fixed scroll part 2 may be varied such that the first gap 15 is gradually increased from its outer peripheral side to inner peripheral side, and the height of the lap 2*a* of the fixed scroll part 2 may be varied such that the second gap 16 is gradually increased from its outer peripheral side to inner peripheral side. In the case of this structure, the height of the lap 4*a* and the thickness of the mirror plate 4*b* are set constant.

Second Embodiment

Next, a scroll compressor of a second embodiment of the present invention will be explained. The scroll compressor of the second embodiment is different from that of the first embodiment in that the heights of the lap of the orbiting scroll part and the thickness of the mirror plate are set such that carbon dioxide can be used as a refrigerant, and other structure is the same as that of the first embodiment and thus, the second embodiment will be explained using the drawings of the first embodiment.

That is, when the carbon dioxide is used as the refrigerant, the operation pressure of the compressor is extremely high as compared with conventional CFCs refrigerant is used, and also at the time of steady operation, the discharge pressure rises as high as 10 MPa and the suction pressure rises as high as about 4 MPa. At that time a large pressure difference is generated between the compression chamber 5 of the mirror plate 4*b* of the orbiting scroll part 4 and the back pressure chamber 8 of the mirror plate 4*b* of the orbiting scroll part 4.

Here, when the thickness t of the mirror plate 4*b* of the orbiting scroll part 4 is set to over 3.0 times of the height H of the lap 4*a*, sufficient rigidity with respect to a force (the above pressure difference) for distorting the orbiting scroll part 4 is obtained, and the orbiting scroll part 4 is not deformed. If the orbiting scroll part 4 is not deformed at all, however, the teeth tips of the fixed scroll part 2 and the teeth bottoms of the orbiting scroll part 4 come into contact unevenly, and galling or abnormal wearing is generated in some cases.

Therefore, in the scroll compressor of the embodiment, the thickness t of the mirror plate 4*b* of the orbiting scroll part 4 is set to 1.0 times of more and 3.0 times or less of the height H of the lap 4*a*. In this case, the orbiting scroll part 4 is flexibly deformed by the pressure difference.

In other words, the orbiting scroll part 4 is appropriately deformed with respect to the pressure difference when the carbon dioxide refrigerant is used, the contact pressure of the teeth tips of the fixed scroll part 2 and the teeth bottoms of the orbiting scroll part 4 is equally maintained by the first gap 15 and the second gap 16, galling or abnormal wearing is not generated, and it is possible to provide a reliable scroll compressor.

When HFC-based or HCFC based refrigerant is used, the thickness t of the mirror plate 4*b* of the orbiting scroll part 4 is set to 0.3 times or more and 1.0 times or less of the height H of the lap 4*a*. In this case, the orbiting scroll part 4 is flexibly deformed with respect to the pressure difference generated in accordance with the HFC-based or HCFC based refrigerant. Therefore, the contact pressure of the teeth tips of the fixed scroll part 2 and the teeth bottoms of the orbiting scroll part 4 is equally maintained by the first gap 15 and the second gap 16, galling or abnormal wearing is not generated, and it is possible to provide a reliable scroll compressor.

When HC-based refrigerant is used as the refrigerant, the thickness t of the mirror plate 4*b* of the orbiting scroll part 4 is set to 0.2 times or more and 0.6 times or less of the height H of the lap 4*a*. In this case also, the orbiting scroll part 4 is flexibly deformed with respect to the pressure difference generated in accordance with the HC-based refrigerant, the contact pressure of the teeth tips of the fixed scroll part 2 and the teeth bottoms of the orbiting scroll part 4 is equally maintained by the first gap 15 and the second gap 16, galling or abnormal wearing is not generated, and it is possible to provide a reliable scroll compressor.

In this embodiment, explanation of the materials of the fixed scroll part 2 and the orbiting scroll part 4 is omitted, Fe-based material may be used for the fixed scroll part 2 and Al-based material may be used for the orbiting scroll part 4. If the fixed scroll part 2 and the orbiting scroll part 4 are made of different metals having different coefficients of thermal expansion in this manner, more remarkable effect can be obtained.

Third Embodiment

Figure 4:
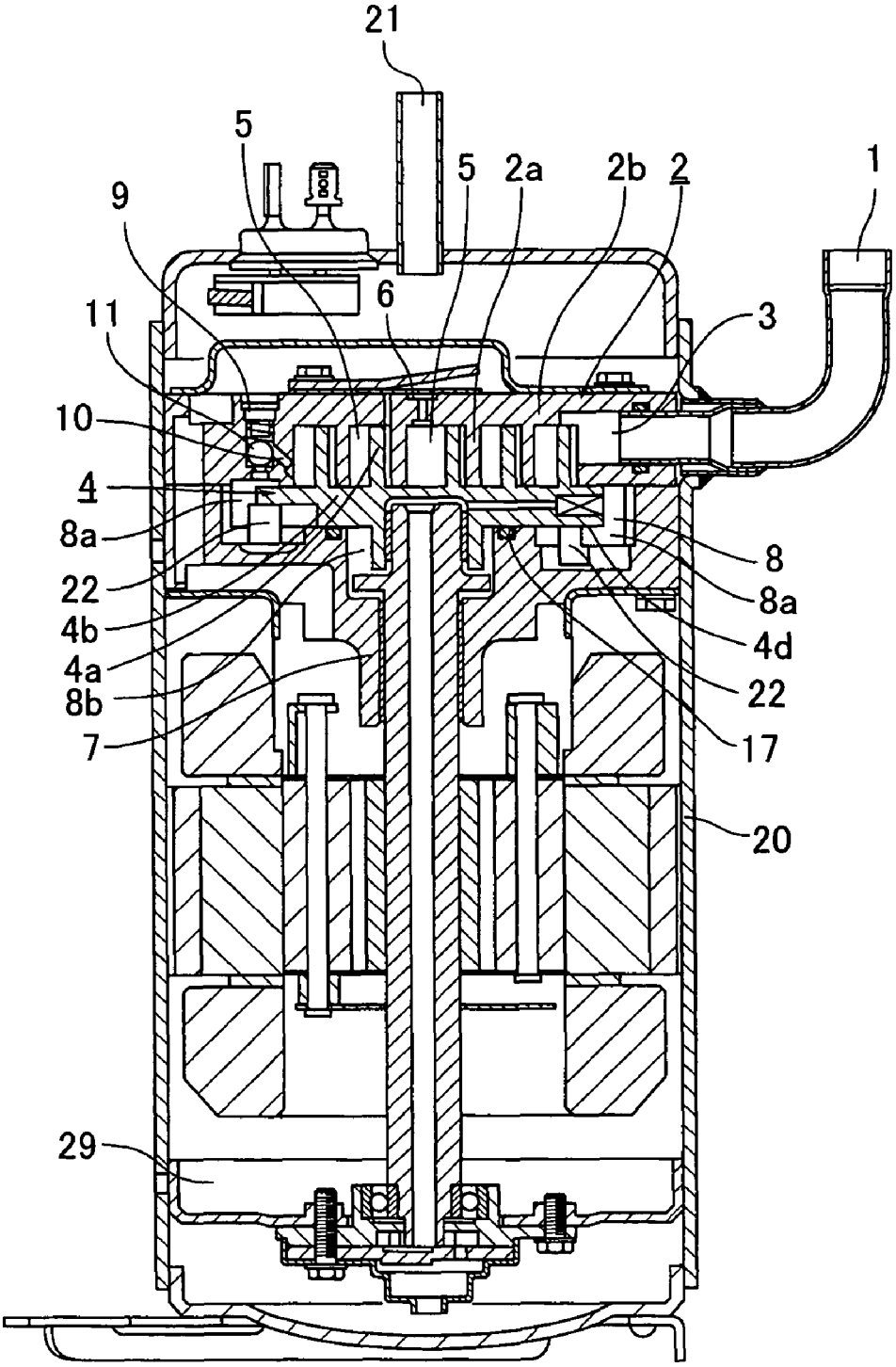
FIG. 4 is a vertical sectional view showing a scroll compressor according to a third embodiment of the invention.
Figure 5:
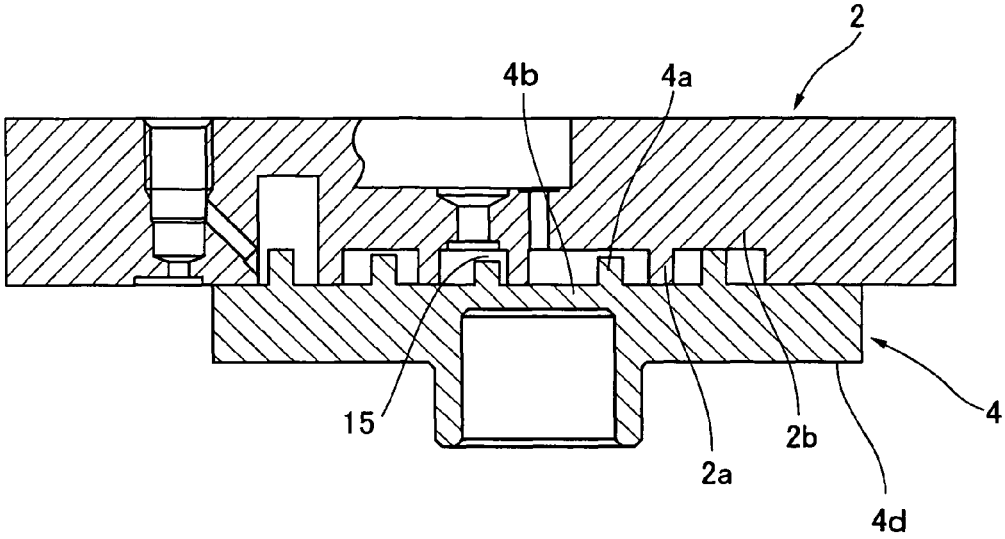
FIG. 5 is a sectional view of an essential portion of a compression mechanism of the scroll compressor shown in FIG. 4.
Figure 6:
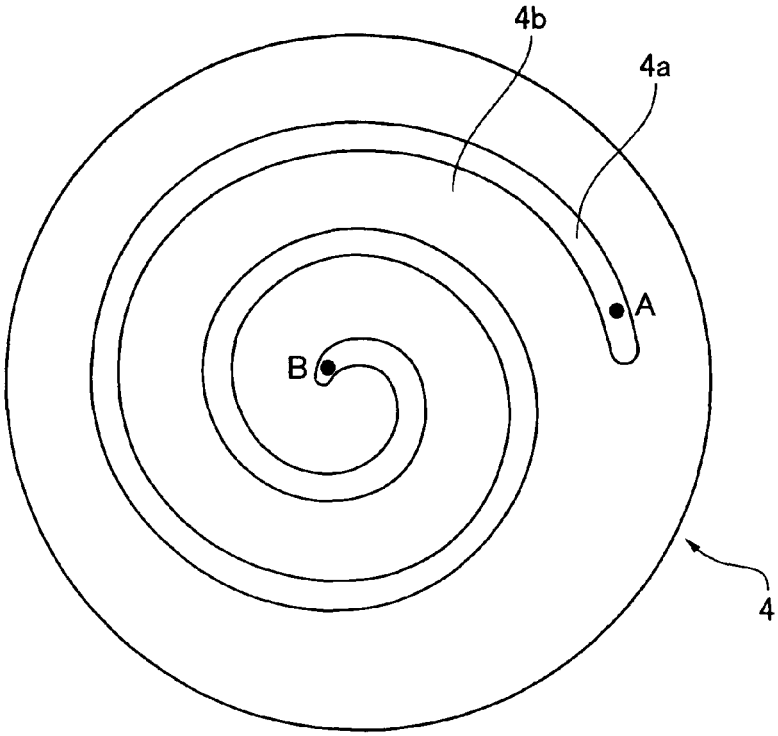
FIG. 6 is a plan view of an orbiting scroll part of the scroll compressor shown in FIG. 4.
Figure 8:
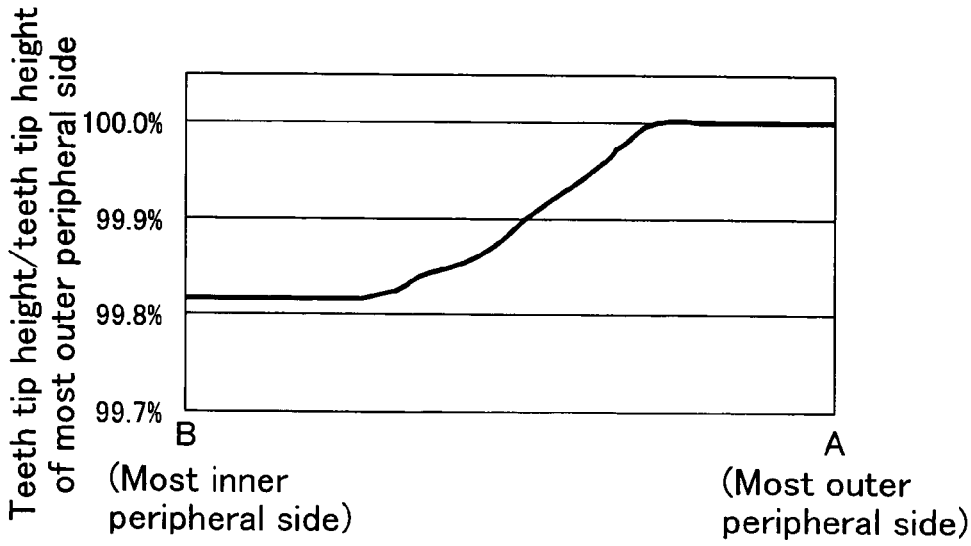
FIG. 8 is a graph showing a height ratio of an orbiting lap of the orbiting scroll part of the scroll compressor shown in FIG. 4.
Figure 17:
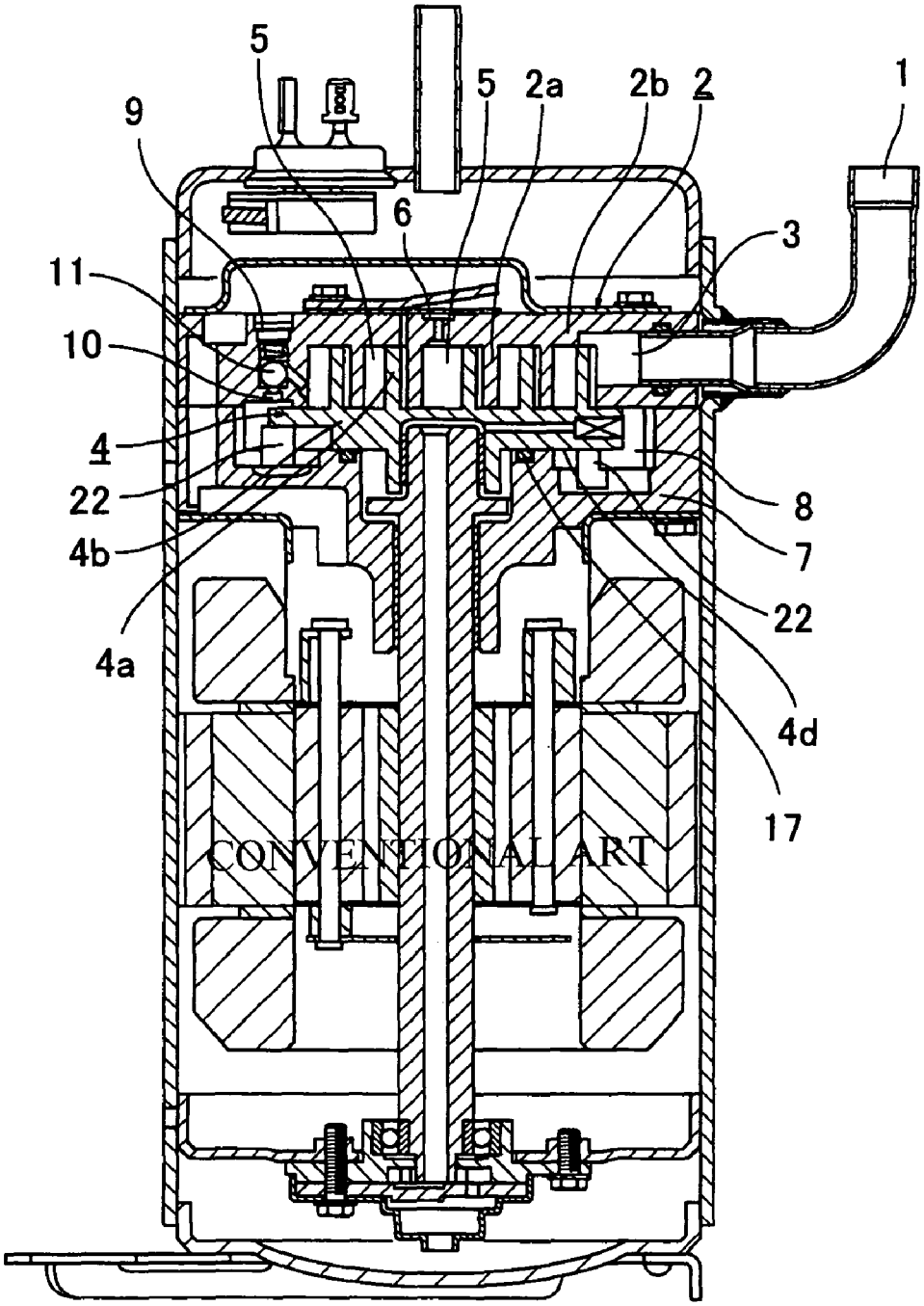
Fig. 17 RELATED ART
FIG. 17 is a vertical sectional view showing a conventional scroll compressor.

Next, a scroll compressor of a third embodiment of the present invention will be explained. FIG. 4 is a vertical sectional view showing the scroll compressor according to the third embodiment of the invention. FIG. 5 is a sectional view of an essential portion of a compression mechanism of the scroll compressor shown in FIG. 4. FIG. 6 is a plan view of an orbiting scroll part of the scroll compressor shown in FIG. 4. FIG. 7 is a sectional view of a side surface of the orbiting scroll part of the scroll compressor shown in FIG. 4. FIG. 8 is a graph showing a height ratio of an orbiting lap of the orbiting scroll part of the scroll compressor shown in FIG. 4. In this embodiment, the same members as those of the conventional scroll compressor shown in FIG. 17 are designated with the same symbols, and the same is applied to the subsequent fourth to tenth embodiments also.

The scroll compressor of this embodiment includes a compression mechanism and a motor mechanism in a container 20. The compression mechanism is disposed at an upper portion in the container 20, and the motor mechanism is disposed below the compression mechanism. The container 20 is provided at its upper portion with the suction pipe 1 and the discharge pipe 21. The container 20 is provided at its lower portion with an oil reservoir 29 for accumulating lubricant oil.

The compressor mechanism includes a fixed scroll part 2 and an orbiting scroll part 4. The fixed scroll part 2 and the orbiting scroll part 4 are meshed with each other to form a plurality of compression chambers 5. The fixed scroll part 2 has a scroll lap 2*a* rising from a mirror plate 2*b*, and the orbiting scroll part 4 has a scroll lap 4*a* rising from a mirror plate 4*b*. The compression chamber 5 is formed between the mirror plate 2*b* and the mirror plate 4*b* by meshing the lap 2*a* and the lap 4*a* with each other.

The orbiting scroll part 4 is restrained from rotating by a rotation-restraint mechanism 22, and the orbiting scroll part 4 orbits in a circular orbit. The compression chamber 5 moves while varying its capacity by orbiting motion of the orbiting scroll part 4.

A back surface 4*d* of the orbiting scroll part 4 is provided with a back pressure chamber 8. In the back pressure chamber 8, a sliding partition ring 17 is disposed in a circular groove provide in the bearing member 7, and the back pressure chamber 8 is divided into two, i.e., an inner region 8*b* and an outer region 8*a* by this sliding partition ring 17. High discharge pressure is applied to the inner region 8*b*. Predetermined intermediate pressure between the suction pressure and the discharge pressure is applied to the outer region 8*a*. Thrust is applied to the orbiting scroll part 4 by the pressure of the back pressure chamber 8, the orbiting scroll part 4 is stably pushed against the fixed scroll part 2, leakage is reduced, and the orbiting scroll part 4 stably orbits circularly.

According to the scroll compressor of the embodiment, the fixed scroll part 2 is made of iron-based material, the orbiting scroll part 4 is made of aluminum-based material, the orbiting scroll part 4 is subjected to surface processing and a hard layer is formed thereon. Any of alumite coating processing, PVD processing and nickel phosphorus plating processing is carried out as the surface processing.

The orbiting scroll part 4 is subjected to lapping processing, buff processing or barrel polishing processing after surface processing. By reducing roughness caused by the surface processing by the lapping processing, buff processing or barrel polishing processing, friction resistance is reduced, the reliability of sliding surface of the orbiting scroll part 4 is enhanced, and sliding loss is reduced to enhance the performance, high efficiency can be obtained from the initial stage of operation.

With this above structure, when the carbon dioxide is used as a refrigerant, the discharge pressure of the compressor becomes higher, by about 7 to 10 times, than the high-pressure side pressure of the conventional refrigeration cycle in which CFCs is used as the refrigerant, and if such a back pressure that the orbiting scroll part 4 is not separated from the fixed scroll part 2 is given, the orbiting scroll part 4 is pushed against the fixed scroll part 2 strongly, but due to the hardened layer obtained by the surface processing of the orbiting scroll part 4, it is possible to obtain a reliable scroll compressor having no seizing. In the case of a large capacity system using a large amount of refrigerant, at the time of transient operation such as starting operation and defrosting operation, liquid abruptly returns to the scroll compressor, the lubricant oil is washed away by the liquid refrigerant due to the liquid return, the lubricating state is deteriorated, but no seizing is generated due to the hardened layer obtained by the surface processing, and it is possible to operate the scroll compressor at high speed.

The teeth tips of the lap 4*a* are inclined so that at room temperature, the first gap 15 in the thrust direction between the teeth bottoms of the mirror plate 2*b* of the fixed scroll part 2 and the teeth tips of the lap 4*a* of the orbiting scroll part 4 is increased from the outer peripheral side A toward the inner peripheral side B.

The inclination ratio of the teeth tips of the lap 4*a* will be explained using FIG. 8.

FIG. 8 shows the heights of the teeth tips of the lap 4*a* of the orbiting scroll part 4 after the scroll compressor is operated under high load. FIG. 8 shows a ratio of the height of the lap 4*a* at various positions when the height of the lap 4*a* on the outer peripheral side A is defined as 100.

The temperature of the orbiting scroll part 4 becomes higher toward its center due to the compression heat generated in the course of compression, the orbiting scroll part 4 is deformed by thermally expansion, and is deformed by large pressure difference. In order to prevent the teeth tips of the lap 4*a* of the orbiting scroll part 4 from coming into contact with the teeth bottoms of the mirror plate 2*b* of the fixed scroll part 2, the teeth tips of the lap 4*a* are inclined such that the height of its inner peripheral side becomes the smallest. If the smallest teeth tip height of the lap 4*a* is set to 99.6% or less of the largest teeth tip height, the leakage from the teeth tips is increased, and the performance is deteriorated. Therefore, it is preferable that the smallest teeth tip height of the inner peripheral side lap 4*a* is 99.6% or more and less than 100% of the largest teeth tip height of the outer peripheral side lap 4*a*.

Fourth Embodiment

Figure 9:
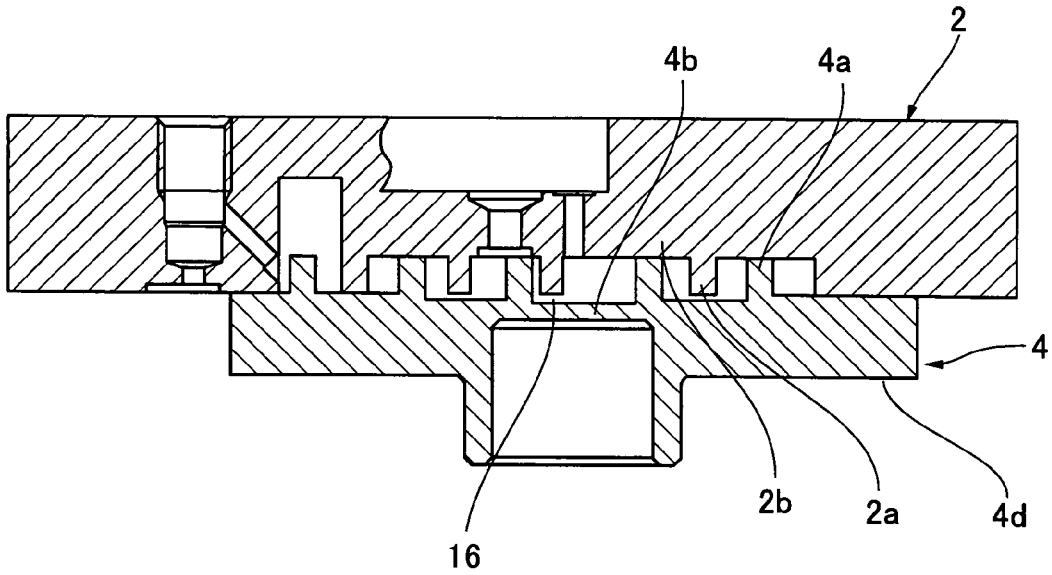
FIG. 9 is a sectional view of an essential portion of a scroll compressor according to a fourth embodiment of the invention.

Next, a scroll compressor of a fourth embodiment of the present invention will be explained. FIG. 9 is a sectional view of an essential portion of the scroll compressor according to the fourth embodiment of the invention. The scroll compressor of the fourth embodiment has the same structure as that of the third embodiment except the teeth bottoms of the mirror plate 4*b* of the orbiting scroll part 4, and explanation of the same portions will be omitted.

In the fourth embodiment, the teeth bottoms of the mirror plate 4*b* of the orbiting scroll part 4 are inclined so that the second gap 16 in the thrust direction between the teeth bottoms of the mirror plate 4*b* of the orbiting scroll part 4 and the teeth tips of the lap 2*a* of the fixed scroll part 2 is increased from the outer peripheral side toward the inner peripheral side. With this structure, when the scroll compressor is operated with large pressure difference while using carbon dioxide as a refrigerant, since it is possible to prevent the teeth tips of the lap 2*a* from locally coming into contact with the teeth bottoms of the mirror plate 4*b* of the orbiting scroll part 4 due to pressure strain or temperature strain, and the fixed scroll part 2 receives with equal surface pressure, reliability is enhanced.

Although the teeth tips of the lap 4*a* and the teeth bottoms of the mirror plate 4*b* are inclined in the different embodiments, both the teeth tips of the lap 4*a* and the teeth bottoms of the mirror plate 4*b* may be inclined.

Fifth Embodiment

Figure 10:
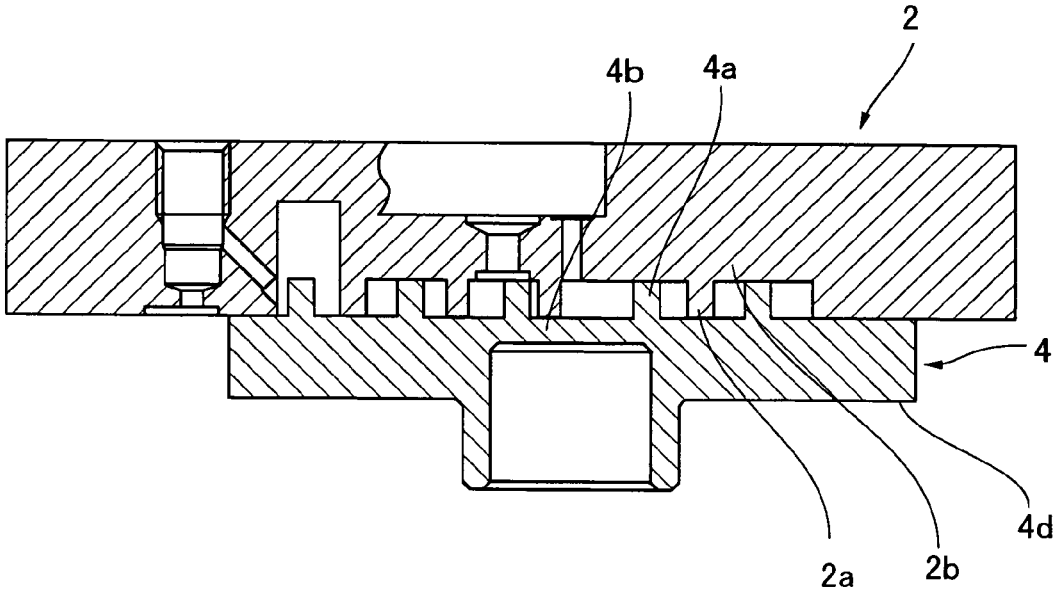
FIG. 10 is a sectional view of an essential portion of a scroll compressor according to a fifth embodiment of the invention.

Next, a scroll compressor of a fifth embodiment of the present invention will be explained. FIG. 10 is a sectional view of an essential portion of the scroll compressor according to the fifth embodiment of the invention.

According to the scroll compressor of the fifth embodiment, the lap 4*a* of the orbiting scroll part 4 is subjected to the surface processing except the teeth tips without inclining the teeth tips of the lap 4*a* and the teeth bottoms of the mirror plate 4*b*. Except this structure, the fifth embodiment is the same as the third embodiment and thus, explanation of the same portions will be omitted.

According to this embodiment, even if thermally expansion caused by compression heat and pressure deformation caused by large pressure difference is generated at the center in the course of compression, since the teeth tips of the lap 4*a* is not subjected to the surface processing for providing a hardened layer, no seizing is generated. That is, the lap 4*a* of the orbiting scroll part 4 is adjusted by wearing such that the lap 4*a* matches with the thrust direction gap between the teeth tips of the lap 2*a* of the fixed scroll part 2 and the teeth bottoms of the mirror plate 2*b* of the fixed scroll part 2. Therefore, it is unnecessary to previously incline the teeth tips of the lap 4*a* of the orbiting scroll part 4, both the performance of compressor and reliability thereof can be enhanced, and the cost can be reduced.

Even if the teeth bottoms of the mirror plate 2*b* are inclined instead of inclining the teeth tips of the lap 4*a*, the same effect can be obtained of course.

Even if the teeth tips of the lap 2*a* are inclined instead of inclining the teeth bottoms of the mirror plate 4*b*, the same effect can be obtained of course.

Sixth Embodiment

Figure 11:
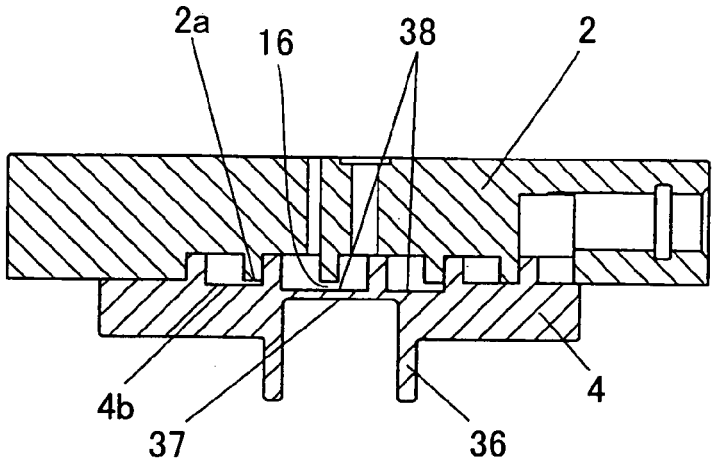
FIG. 11 is a sectional view of an essential portion of a scroll compressor according to a sixth embodiment of the invention.
Figure 12:
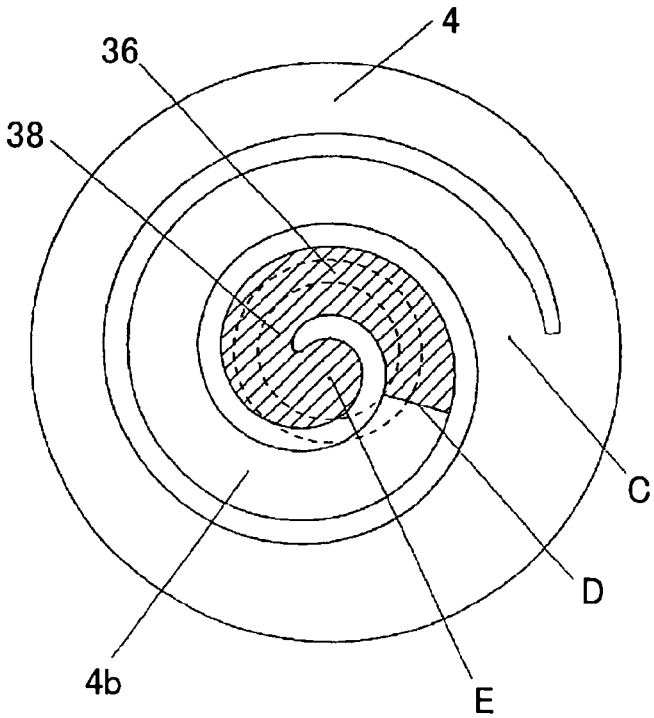
FIG. 12 is a plan view of an orbiting scroll part of the scroll compressor shown in FIG. 11.

Next, a scroll compressor of a sixth embodiment of the present invention will be explained. FIG. 11 is a sectional view of an essential portion of the scroll compressor according to the sixth embodiment of the invention. FIG. 12 is a plan view of an orbiting scroll part of the scroll compressor shown in FIG. 11. The scroll compressor of the sixth embodiment is substantially the same as that of the third embodiment, only the essential portions of the scroll parts will be explained, and explanation of other portions will be omitted. The same is applied to seventh to tenth embodiments also.

As shown in the drawings, the teeth bottoms of the mirror plate 4*b* of the orbiting scroll part 4 are inclined such that at room temperature, the second gap 16 in the thrust direction between the teeth bottoms of the mirror plate 4*b* of the orbiting scroll part 4 and the teeth tips of the lap 2*a* of the fixed scroll part 2 is increased from the outer peripheral side toward the inner peripheral side. In a housing 37 of an eccentric bearing 36 shown with hatching in FIG. 12, the teeth bottom of the mirror plate 4*b* of the orbiting scroll part 4 is formed with a flat portion 38.

Figure 13:
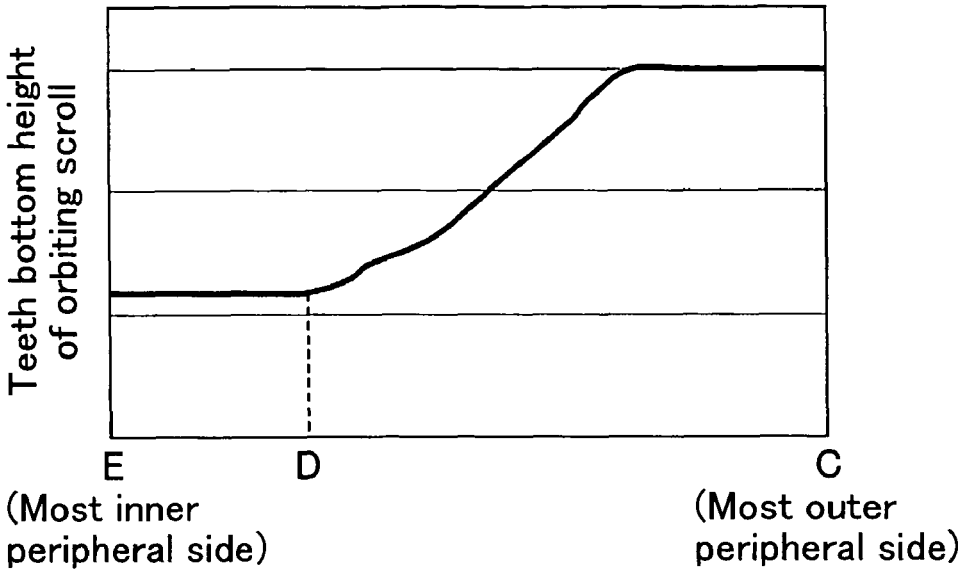
FIG. 13 is a graph showing a shape of teeth bottom of the orbiting scroll part of the scroll compressor shown in FIG. 11 after the scroll compressor is operated under high load.

One example of the inclination will be explained in more detail. FIG. 13 is a graph showing a shape of teeth bottom of the orbiting scroll part of the scroll compressor shown in FIG. 11 after the scroll compressor is operated under high load. If high pressure is applied to a mirror plate back surface, the teeth bottoms of the mirror plate 4*b* of the orbiting scroll part 4 are pushed against the fixed scroll part, the teeth bottoms are deformed under pressure into a shape as shown in the drawing. Especially in the housing 37 of the eccentric bearing 36 of the orbiting scroll part 4, since the thickness of the mirror plate is thinnest, the flat portion 38 having the smallest mirror plate thickness as shown in the drawing is formed by pressure deformation.

As shown in the drawing, the height of the teeth bottoms becomes higher from the inner peripheral side toward the outer peripheral side so that a surface pressure (pressure) generated between the teeth bottom of the mirror plate 4*b* of the orbiting scroll part 4 and the teeth tip end of the lap 2*a* of the fixed scroll part 2 is equal over the entire region from the most inner peripheral position to the most outer peripheral position.

With the above structure, in the housing 37 of the thin eccentric bearing 36 of the mirror plate 4*b* of the orbiting scroll part 4, even if pressure deformation is generated due to the pressure difference between the discharge pressure and the suction pressure, the teeth bottoms of the mirror plate 4*b* of the orbiting scroll part 4 and the teeth tips of the lap 2*a* of the fixed scroll part 2 do not eccentrically abut against each other but come into equal contact with each other, it is possible to enhance the reliability and to realize the high efficiency from the initial stage of the operation.

Seventh Embodiment

Figure 14:
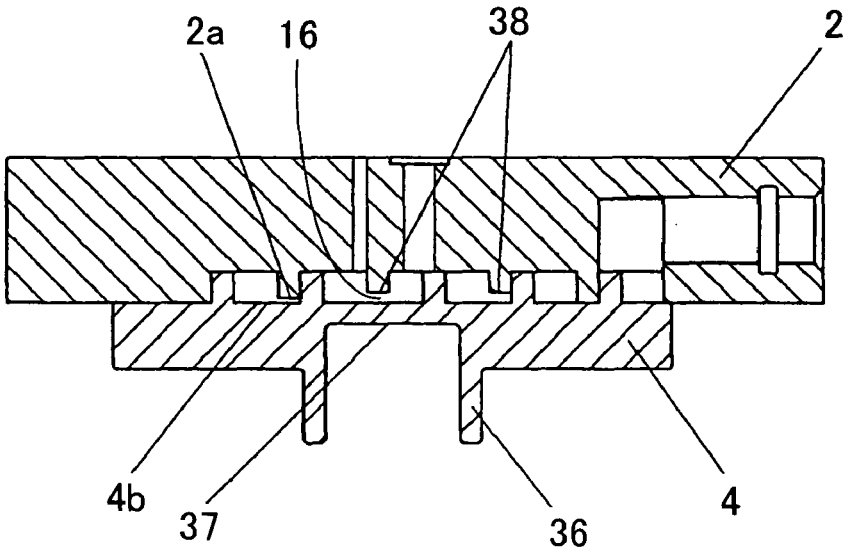
FIG. 14 is a sectional view of an essential portion of a scroll compressor according to a seventh embodiment of the invention.

Next, a scroll compressor of a seventh embodiment of the present invention will be explained. FIG. 14 is a sectional view of an essential portion of the scroll compressor according to the seventh embodiment of the invention.

As show in FIG. 14, teeth tips of the lap 2*a* of the fixed scroll part 2 are inclined such that the height of the lap is reduced from the outer peripheral side to the inner peripheral side, and in a range opposed to the housing 37 of the eccentric bearing 36 of the orbiting scroll part 4, a flat portion 38 having the smallest teeth tip of the lap 2*a* of the fixed scroll part 2 is provided. With these structures, the same effect can be obtained of course.

Eighth Embodiment

Figure 15:
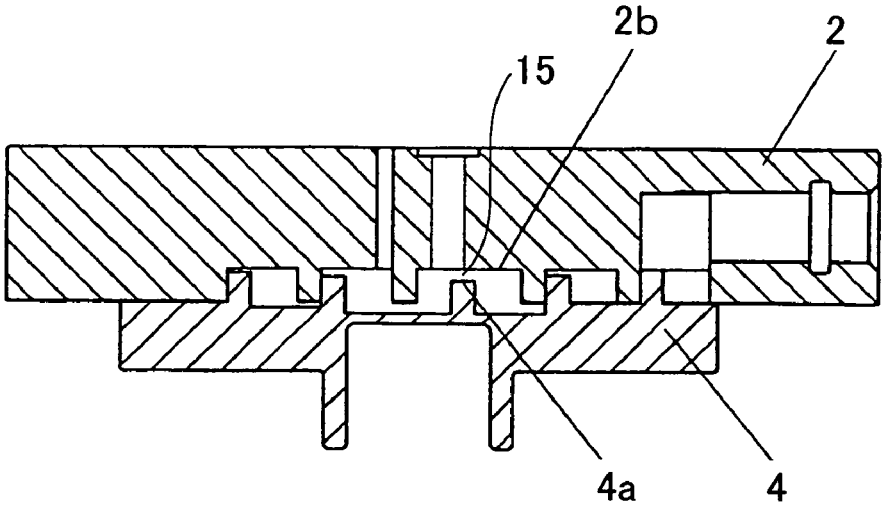
FIG. 15 is a sectional view of an essential portion of a scroll compressor according to an eighth embodiment of the invention.

Next, a scroll compressor of an eighth embodiment of the present invention will be explained. FIG. 15 is a sectional view of an essential portion of the scroll compressor according to the eighth embodiment of the invention.

As shown in FIG. 15, the teeth tips of the lap 4*a* of the orbiting scroll part 4 are inclined such that at room temperature, the first gap 15 in the thrust direction between the teeth tips of the lap 4*a* of the orbiting scroll part 4 and the teeth bottoms of the mirror plate 2*b* of the fixed scroll part 2 is increased from the outer peripheral side to the inner peripheral side.

Compression heat is generated at the center portion in the course of compression and the center portion is heated to high temperature. Thus, the temperature of the teeth tips of the lap 4*a* of the orbiting scroll part 4 becomes higher toward its center due to the thermally expansion. However, since the teeth tips of the lap 4*a* of the orbiting scroll part 4 are inclined such that the first gap 15 in the thrust direction is increased from the outer peripheral side to the inner peripheral side, the teeth tips do not come into contact with the teeth bottoms of the mirror plate 2*b* of the fixed scroll part 2, and it is possible to enhance the reliability and to realize the high efficiency from the initial stage of the operation.

Ninth Embodiment

Figure 16:
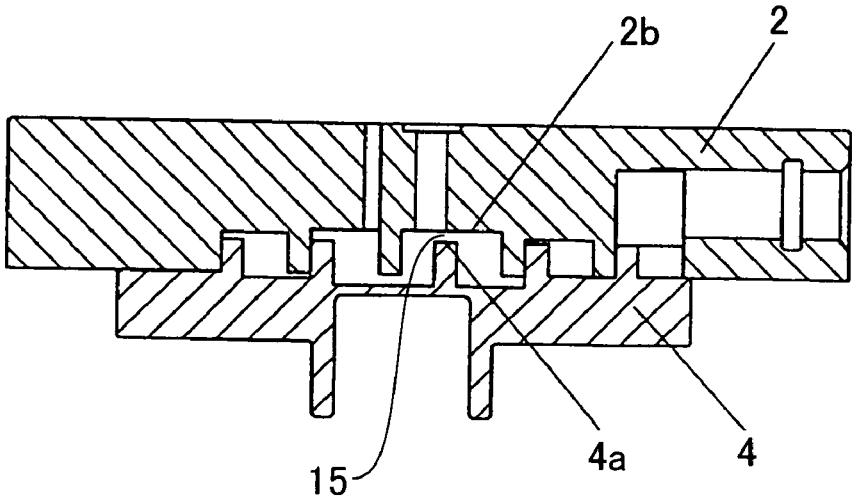
FIG. 16 is a sectional view of an essential portion of a scroll compressor according to a ninth embodiment of the invention.

Next, a scroll compressor of a ninth embodiment of the present invention will be explained. FIG. 16 is a sectional view of an essential portion of the scroll compressor according to the ninth embodiment of the invention.

As shown in FIG. 16, the teeth bottoms of the mirror plate 2*b* of the fixed scroll part 2 are inclined so that the first gap 15 in the thrust direction between the teeth tips of the lap 4*a* of the orbiting scroll part 4 and the teeth bottoms of the mirror plate 2*b* of the fixed scroll part 2 is increased from the outer peripheral side to the inner peripheral side. With this structure also, the same effect can be obtained of course.

Tenth Embodiment

Next, a scroll compressor (not shown) of a tenth embodiment of the present invention will be explained.

In the scroll compressor of this embodiment, the fixed scroll part 2 is made of iron-based material, the orbiting scroll part 4 is made of aluminum-based material and subjected to the surface processing, and a hardened layer is formed on the surface. Examples of the surface processing are alumite coating processing, PVD processing and nickel phosphorus plating processing.

With the above structure, the discharge pressure of the compressor is high, and if such a back pressure that the orbiting scroll part 4 is not separated from the fixed scroll part 2 is given, the orbiting scroll part 4 is strongly pushed against the fixed scroll part 2, but seizing is prevented by the hardened layer formed by the surface processing carried out for the orbiting scroll part 4, and it is possible to obtain a reliable scroll compressor. In a large capacity system using a large amount of refrigerant, liquid returns to the scroll compressor abruptly at the time of transient operation such as starting operation and defrosting operation, the lubricant oil is washed away by the liquid refrigerant due to the liquid return, the lubricating state is deteriorated, but no seizing is generated due to the hardened layer obtained by the surface processing, and it is possible to operate the scroll compressor at high speed.

When high pressure refrigerant such as carbon dioxide is used as the refrigerant, the discharge pressure of the compressor on the high pressure side is higher than that of the conventional compressor by about 7 to 10 times. In the present invention, however, the temperature strain and pressure deformation of the orbiting scroll part 4 and the fixed scroll part 2 are taken into consideration, local abutment is not caused, they receive with the equal surface pressure, it is possible to provide a reliable scroll compressor capable of realizing high efficiency from the initial stage of operation.

According to the present invention, a first gap in a thrust direction between teeth bottoms of the fixed mirror plate and teeth tips of the orbiting lap and a second gap in a thrust direction between teeth bottoms of the orbiting mirror plate and teeth tips of the fixed lap are formed into such shapes that the first and second gaps are gradually increased from an outer peripheral side to an inner peripheral side of the scroll compressor, and the first gap is made greater than the second gap. With this, since the first gap and the second gap are gradually increased from the outer peripheral side to the inner peripheral side, the contact surface pressure of the lap caused by the thermally expansion can be maintained at low level, and even if the fixed scroll part is downwardly concaved by the discharge pressure, since the first gap greater than the suction pressure absorbs the pressure deformed portion, the contact pressure between the teeth tips of the fixed scroll part and the teeth bottoms of the orbiting scroll part is maintained equally. Therefore, galling or abnormal wearing is not generated, and it is possible to provide a reliable scroll compressor.

Further, the first gap is formed such that height of the orbiting lap is varied, and second gap is formed such that thickness of the orbiting mirror plate is varied. With this aspect, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

Further, the first gap is formed such that the height of the orbiting lap is varied, and the second gap is formed such that height of the fixed lap is varied. With this, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

Further, the first gap is formed such that thickness of the fixed mirror plate is changed, and second gap is formed such that the thickness of the orbiting mirror plate is changed. With this, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

Further, the first gap is formed such that the thickness of the fixed mirror plate is changed, and second gap is formed such that the height of the fixed lap is varied. With this, it becomes possible to easily and inexpensively increase the first gap and the second gap gradually from the outer peripheral side to the inner peripheral side, and make the first gap greater than the second gap. With this, galling or abnormal wearing is not generated, and it is possible to provide a reliable scroll compressor.

Further, carbon dioxide is used as the refrigerant, and the thickness of the orbiting mirror plate is smaller than 3.0 times of the height of the orbiting lap. With this, the orbiting scroll part having appropriate relation between the thickness of the mirror plate and the height of the lap is flexibly deformed with respect to the pressure difference between the discharge pressure and the suction pressure when carbon dioxide refrigerant is used, the contact pressure of the teeth tips of the fixed scroll part and the teeth bottoms of the orbiting scroll part is maintained more equally, galling or abnormal wearing is not generated, and it is possible to provide a reliable scroll compressor.

Further, HFC-based refrigerant or HCFC-based refrigerant is used as the refrigerant, and the thickness of the orbiting mirror plate is smaller than 1.0 times of the height of the orbiting lap. With this, the orbiting scroll part having appropriate relation between the thickness of the mirror plate and the height of the lap is flexibly deformed with respect to the pressure difference between the discharge pressure and the suction pressure when HFC-based refrigerant or HCFC-based refrigerant is used, the contact pressure of the teeth tips of the fixed scroll part and the teeth bottoms of the orbiting scroll part is maintained more equally, galling or abnormal wearing is not generated, and it is possible to provide a reliable scroll compressor.

Further, HC-based refrigerant is used as the refrigerant, and the thickness of the orbiting mirror plate is smaller than 0.6 times of the height of the orbiting lap. With this, the orbiting scroll part having appropriate relation between the thickness of the mirror plate and the height of the lap is flexibly deformed with respect to the pressure difference between the discharge pressure and the suction pressure when HC-based refrigerant is used, the contact pressure of the teeth tips of the fixed scroll part and the teeth bottoms of the orbiting scroll part is maintained more equally, galling or abnormal wearing is not generated, and it is possible to provide a reliable scroll compressor.

Further, the fixed scroll part is made of iron-based material, the orbiting scroll part is made of aluminum-based material, the orbiting scroll part is subjected to surface processing, teeth tips of the orbiting lap are inclined such that a first gap in thrust direction between teeth bottoms of the fixed mirror plate and teeth tips of the orbiting lap is increased from an outer peripheral side to an inner peripheral side of the scroll compressor. Therefore, when the scroll compressor is operated with large pressure difference while using carbon dioxide as the refrigerant, even if the teeth bottoms of the orbiting mirror plate are strongly pushed against the teeth tips of the fixed lap, abnormal wearing is suppressed by the surface processing having the hardened layer, and the scroll compressor can be operated without generating seizing.

That is, according to the invention, also at the time of transient operation of the scroll compressor having abrupt liquid refrigerant return in a large capacity system using a large amount of refrigerant, lubricant oil on the thrust surface of the orbiting scroll part is not washed away by carbon dioxide liquid refrigerant having high cleaning ability, and seizing by temperature rise is not generated. According to this aspect, since the orbiting scroll part is made of aluminum-based material, the centrifugal force of the driving portion at the time of high speed operation can be reduced, durability is excellent, and sliding loss can be reduced.

Further, according to the invention, the teeth tips of the orbiting lap are inclined such that the first gap in the thrust direction between teeth bottoms of the fixed mirror plate and the teeth tips of the orbiting lap is increased from an outer peripheral side to an inner peripheral side of the scroll compressor. With this, it is possible to prevent the teeth tips at the center of the lap in the orbiting scroll part from coming into contact with the high compression heat generated at the center portion in the course of compression.

Further, the smallest height of the orbiting lap on inner peripheral side is 99.6% or more and less than 100% of the largest height of the orbiting lap on outer peripheral side. With this, leakage loss from the teeth tip surface of each lap is reduced, it is possible to prevent galling in the teeth tip surface of each lap, and leakage from the teeth tip can be suppressed to the minimum value, and it is possible to enhance both performance and reliability of the compressor.

Further, carbon dioxide is used as a refrigerant, the fixed scroll part is made of iron-based material, the orbiting scroll part is made of aluminum-based material, and the orbiting lap is subjected to surface processing except teeth tips thereof. With this, it is possible to prevent the teeth tips of the center portion of the lap in the orbiting scroll part from coming into contact with high compression heat generated at the center portion in the course of compression. Even if the center teeth tip of the lap comes into contact with the high compression heat, since the teeth tip is not subjected to the surface processing, the thrust direction gap between the teeth tips of the fixed scroll part and the teeth bottoms of the fixed mirror plate is adjusted without generating seizing during operation. Therefore, it is possible to enhance both performance and reliability of the compressor and thus, cost can be reduced.

Further, teeth bottoms of the orbiting mirror plate are inclined such that a second gap in thrust direction between the teeth bottoms of the orbiting mirror plate and teeth tips of the fixed lap is increased from outer peripheral side to inner peripheral side of the scroll compressor. With this, when the scroll compressor is operated with large pressure difference while using carbon dioxide as the refrigerant, it is possible to prevent the teeth tips of the scroll lap of the fixed scroll part from coming into contact with the teeth bottoms of the teeth bottoms of the orbiting mirror plate, and the reliability is enhanced.

Further, any of alumite coating processing, PVD processing and nickel phosphorus plating processing is carried out as the surface processing. With this, even if the pressure difference of he carbon dioxide refrigerant is high, wear of film having the hardened layer by slide by slide is small, the surface processing film remains even if the scroll compressor is used for a long time, seizing is not generated, and the reliability is enhanced.

Further, a portion subjected to the surface processing is subjected to any of lapping processing, buff processing and barrel polishing processing. With this, by reducing the roughness caused by the surface processing, the sliding loss is reduced to enhance performance, and high efficiency can be obtained from the initial stage of operation.

Further, in the scroll compressor, the shapes of the orbiting scroll and the fixed scroll are optimized. With this, the teeth bottoms of the orbiting scroll and the teeth tips of the fixed scroll can come into contact with each other equally, the reliability can be enhanced, and high efficiency can be realized from the initial stage of operation.

INDUSTRIAL APPLICABILITY

According to the present invention, it is possible to provide an efficiency and reliable scroll compressor especially when carbon dioxide is used as a refrigerant. The scroll compressor of the present invention can be utilized as a refrigeration air conditioning hermetic compressor for domestic or business purpose. Working fluid is not limited to the refrigerant. The present invention can be applied to a scroll fluid machine such as an air scroll compressor, a vacuum pump, an oil-free compressor, a scroll expander and the like.

The invention claimed is:

1. A scroll compressor in which a scroll fixed lap rising from a fixed mirror plate of a fixed scroll part and a scroll orbiting lap rising from an orbiting mirror plate of an orbiting scroll part are meshed with each other to form compression chambers therebetween, said orbiting scroll part is allowed to orbit in a circular orbit while restraining said orbiting scroll part from rotating by a rotation-restraint mechanism, a refrigerant is sucked, compressed and discharged while continuously varying a capacity of said compression chamber, wherein a first gap in a thrust direction between teeth bottoms of said fixed mirror plate and teeth tips of said orbiting lap and a second gap in a thrust direction between teeth bottoms of said orbiting mirror plate and teeth tips of said fixed lap are formed into such shapes that said first and second gaps are gradually increased from an outer peripheral side to an inner peripheral side of said scroll compressor, and said first gap is made greater than said second gap, and teeth bottoms of said orbiting mirror plate, teeth tips of said fixed lap and outer peripheral thrust surface come into contact before teeth bottoms of said fixed mirror plate and teeth tips of said orbiting lap come into contact and contact pressure of teeth tips of said fixed lap and teeth bottoms of said orbiting mirror plate is equally maintained.

2. The scroll compressor according to claim 1, wherein said first gap is formed such that height of said orbiting lap is varied, and said second gap is formed such that thickness of said orbiting mirror plate is varied.

3. The scroll compressor according to claim 1, wherein said first gap is formed such that height of said orbiting lap is varied, said second gap is formed such that height of said fixed lap is varied.

4. The scroll compressor according to claim 1, wherein said first gap is formed such that thickness of said fixed mirror plate is changed, said second gap is formed such that thickness of said orbiting mirror plate is changed.

5. The scroll compressor according to claim 1, wherein said first gap is formed such that thickness of said fixed mirror plate is changed, said second gap is formed such that height of said fixed lap is varied.

6. The scroll compressor according to claim 1, wherein carbon dioxide is used as said refrigerant, thickness of said orbiting mirror plate is smaller than 3.0 times of height of said orbiting lap.

7. The scroll compressor according to claim 1, wherein HFC-based refrigerant or HCFC-based refrigerant is used as said refrigerant, and thickness of said orbiting mirror plate is smaller than 1.0 times of height of said orbiting lap.

8. The scroll compressor according to claim 1, wherein HC-based refrigerant is used as said refrigerant, and thickness of said orbiting mirror plate is smaller than 0.6 times of height of said orbiting lap.

9. A scroll compressor in which a scroll fixed lap rising from a fixed mirror plate of a fixed scroll part and a scroll orbiting lap rising from an orbiting mirror plate of an orbiting scroll part are meshed with each other to form compression chambers therebetween, said orbiting scroll part is allowed to orbit in a circular orbit while restraining said orbiting scroll part from rotating by a rotation-restraint mechanism, a refrigerant is sucked, compressed and discharged while continuously varying a capacity of said compression chamber, wherein carbon dioxide is used as a refrigerant, said fixed scroll part is made of iron-based material, said orbiting scroll part is made of aluminum-based material, said orbiting scroll part is subjected to surface processing except teeth tips to form a hard layer, said teeth tips of said orbiting scroll part which are not subjected to said surface processing are opposed to said fixed mirror plate of said fixed scroll part, and said orbiting lap of said orbiting scroll part is adjusted by wearing such that said orbiting lap matches with a thrust direction gap between teeth tips of said fixed lap of said fixed scroll part and teeth bottoms of said fixed mirror plate of said fixed scroll part.

10. The scroll compressor according to claim 9, wherein a smallest height of said orbiting lap on inner peripheral side is 99.6% or more and less than 100% of a largest height of said orbiting lap on outer peripheral side.

11. The scroll compressor according to claim 9, wherein teeth bottoms of said orbiting mirror plate are inclined such that a second gap in thrust direction between the teeth bottoms of said orbiting mirror plate and teeth tips of said fixed lap is increased from outer peripheral side to inner peripheral side of said scroll compressor.

12. The scroll compressor according to claim 9, wherein any of alumite coating processing, PVD processing and nickel phosphorus plating processing is carried out as said surface processing.

13. The scroll compressor according to claim 9, wherein a portion subjected to said surface processing is subjected to any of lapping processing, buff processing and barrel polishing processing.

14. A scroll compressor in which a scroll fixed lap rising from a fixed mirror plate of a fixed scroll part and a scroll orbiting lap rising from an orbiting mirror plate of an orbiting scroll part are meshed with each other to form compression chambers therebetween, when said orbiting scroll part is allowed to orbit in a circular orbit while restraining said orbiting scroll part from rotating by a rotation-restraint mechanism, a compression chamber moves while changing its capacity, thereby carrying out suction, compression and discharge, wherein teeth bottoms of said orbiting scroll are inclined such that a second gap in thrust direction between teeth bottoms of said orbiting scroll part and teeth tips of said fixed scroll part is increased from outer peripheral side to inner peripheral side of said scroll compressor, and said teeth bottoms of said orbiting scroll and said teeth tips of said fixed scroll are formed such that said second gap is constant and largest in a range corresponding to a housing of an eccentric bearing of at least said orbiting scroll part, and teeth bottoms of said orbiting mirror plate, teeth tips of said fixed lap and outer peripheral thrust surface come into contact before teeth bottoms of said fixed mirror plate and teeth tips of said orbiting lap come into contact and contact pressure of teeth tips of said fixed lap and teeth bottoms of said orbiting mirror plate is equally maintained.

15. The scroll compressor according to claim 14, wherein said teeth bottoms of said orbiting scroll are formed with an inclined surface which is recessed from its outer peripheral side to inner peripheral side thereof with respect to said fixed scroll such that said second gap is increased from the outer peripheral side to the inner peripheral side, and said teeth bottoms of said orbiting scroll corresponding to the housing of said eccentric bearing of at least said orbiting scroll part is provided with a flat portion which is a largest recess.

16. The scroll compressor according to claim 14, wherein said teeth tips of said fixed scroll part are provided with an inclined surface such that lap height is reduced from the outer peripheral side to the inner peripheral side, and the mirror plate of the orbiting scroll is provided with a flat portion which lap height of said fixed scroll opposed to said teeth bottoms of said orbiting scroll corresponding to the housing of said eccentric bearing of at least said orbiting scroll part becomes a smallest height.

17. The scroll compressor according to claim 14, wherein said teeth tips of said orbiting scroll part are inclined such that a first gap in thrust direction of said teeth tips of said orbiting scroll part and teeth bottoms of said fixed scroll part is increased from the outer peripheral side to the inner peripheral side.

18. The scroll compressor according to claim 14, wherein said teeth bottoms of said fixed scroll part are inclined such that a first gap in thrust direction of said teeth tips of said orbiting scroll part and teeth bottoms of said fixed scroll part is increased from the outer peripheral side to the inner peripheral side.

19. The scroll compressor according to claim 14, wherein said orbiting scroll part is subjected to any of alumite coating processing, PVD processing and nickel phosphorus plating processing as a surface processing.

20. The scroll compressor according to claim 14, wherein high pressure refrigerant is used as a refrigerant.

21. The scroll compressor according to claim 20, wherein the high pressure refrigerant is carbon dioxide.

* * * * *